US010403984B2

(12) United States Patent
Severson et al.

(10) Patent No.: US 10,403,984 B2
(45) Date of Patent: Sep. 3, 2019

(54) DISTRIBUTED DIRECT DRIVE ARRANGEMENT FOR DRIVING CELLS

(71) Applicant: Kymeta Corporation, Redmond, WA (US)

(72) Inventors: Michael Severson, Seattle, WA (US); Nathan Kundtz, Kirkland, WA (US)

(73) Assignee: KYMETA CORPORATION, Redmond, WA (US)

( * ) Notice: Subject to any disclaimer, the term of this patent is extended or adjusted under 35 U.S.C. 154(b) by 335 days.

(21) Appl. No.: 15/374,709

(22) Filed: Dec. 9, 2016

(65) Prior Publication Data

US 2017/0170572 A1 Jun. 15, 2017

Related U.S. Application Data

(60) Provisional application No. 62/267,719, filed on Dec. 15, 2015.

(51) Int. Cl.

| | |
|---|---|
| ***H01Q 1/38*** | (2006.01) |
| ***H01Q 21/06*** | (2006.01) |
| ***H01Q 9/04*** | (2006.01) |
| ***H01Q 21/00*** | (2006.01) |

(52) U.S. Cl.

CPC ..... *H01Q 21/064* (2013.01); *H01Q 1/38* (2013.01); *H01Q 9/0442* (2013.01); *H01Q 21/0012* (2013.01); *H01Q 21/0031* (2013.01)

(58) Field of Classification Search

CPC ..... H01Q 24/06; H01Q 1/38; H01Q 9/04; H01Q 21/00

USPC ..... 343/770

See application file for complete search history.

(56) References Cited

U.S. PATENT DOCUMENTS

| | | | | |
|---|---|---|---|---|
| 2002/0027541 | A1 | 3/2002 | Cairns et al. | |
| 2006/0062071 | A1 * | 3/2006 | Uehara | G11C 7/1051 365/230.03 |
| 2007/0096847 | A1 * | 5/2007 | Trutna, Jr. | H03H 9/462 333/133 |
| 2011/0032775 | A1 * | 2/2011 | Lovett | G11C 7/1048 365/189.06 |

FOREIGN PATENT DOCUMENTS

| | | | |
|---|---|---|---|
| WO | 2015126578 | 8/2015 | |
| WO | WO-2015126578 A1 * | 8/2015 | H01Q 3/34 |

OTHER PUBLICATIONS

International Preliminary Report on Patentability received for PCT Patent Application No. PCT/US2016/066199, dated Jun. 28, 2018, 9 pages.

(Continued)

*Primary Examiner* — Andrea Lindgren Baltzell

(74) *Attorney, Agent, or Firm* — Womble Bond Dickinson (US) LLP

(57) ABSTRACT

A method and apparatus is disclosed herein for a direct drive mechanism for driving cells (e.g., liquid crystal (LC) cells, RF MEMS cells, etc.). In one embodiment, the antenna comprises an antenna element array having a plurality of antenna elements with each antenna element having one or more cells (e.g., liquid crystal (LC) cell, RF MEMS cell, etc.); drive circuitry coupled to cells in the antenna element array to provide a voltage to each of the cells; and memory to store a data value for each cell to determine whether the cell is on or off.

32 Claims, 19 Drawing Sheets

(56) References Cited

OTHER PUBLICATIONS

Notification of Transmittal of the International Search Report and the Written Opinion of the International Searching Authority issued for International Patent Application No. PCT/US2016/066199, dated Feb. 23, 2017.

* cited by examiner

DISTRIBUTED DIRECT DRIVE ARRANGEMENT FOR DRIVING CELLS

PRIORITY

The present patent application claims priority to and incorporates by reference the corresponding provisional patent application Ser. No. 62/267,719, titled, "a-Si DISTRIBUTED DIRECT DRIVE: A MEMORY CELL WITH ANALOG SWITCH IN A MATRIX CONFIGURATION," filed on Dec. 15, 2015.

FIELD OF THE INVENTION

Embodiments of the present invention relate to the field of antennas; more particularly, embodiments of the present invention relate to antennas having a direct drive to drive multiple cells in an antenna element array.

BACKGROUND OF THE INVENTION

Some implementations of an antenna array utilizing thin film transistor (TFT) manufacturing processes have limitations in the refresh rate of the array due to use of high-birefringence liquid crystal (LC) with concomitant low voltage holding ratio. That is, the low voltage holding ratio occurs at the same time as the limitations in the refresh rate of the array due to the high-birefringence LC. To compensate for this, a large storage capacitor is often required to prevent excessive voltage drop. A large storage capacitor in combination with the poor channel resistance, Rds, of typical amorphous silicon TFTs results in large charging time constants, which prevents refresh rates that achieve antenna tracking rate requirements.

More specifically, one way to generate an LC alternating current (AC) drive voltage in the standard matrix architecture is to charge each LC cell with a positive voltage, address each row sequentially, then to charge the LC cell with a negative voltage, and then again addressing each row sequentially at a rate fast enough to maintain the desired LC drive frequency. This method requires updating the matrix at a rate of the drive frequency times the number of rows. This method becomes a challenge as the time to charge the LC cell and storage capacitor increases. The value of the storage capacitance that sets this charge time is determined by the TFT parasitic gate capacitance and its effect on the LC "kickback" voltage. To minimize the kickback voltage, the storage capacitance may need to be large. However, a large storage capacitance means a large charging time, and thus lower refresh rates.

SUMMARY OF THE INVENTION

A method and apparatus is disclosed herein for a direct drive mechanism for driving cells (e.g., liquid crystal (LC) cells, MEMS cells, etc.). In one embodiment, the antenna comprises an antenna element array having a plurality of antenna elements with each antenna element having one or more cells; drive circuitry coupled to cells in the antenna element array to provide a voltage to each of the cells; and memory to store a data value for each cell to determine whether the cell is on or off.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

An antenna with a direct drive for driving antenna elements and a method for using the same are disclosed. In one embodiment, the direct drive includes a plurality of cell drivers distributed over an antenna array of cells. In one embodiment, the cells are liquid crystal (LC) cells. In another embodiment, the cells are microelectromechanical systems (MEMS) radio frequency (RF) resonator cells, each referred to herein as a MEMS cell. Other types of cells may be used and driven by the direct drive techniques described herein. In one embodiment, each cell driver includes a memory cell and an analog switch located in a matrix configuration in an antenna.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Note in the following description, the direct drive is described in conjunction with an LC cell. An RF MEMS cell or other types of cells could be used in place of the LC cell. Specific implementation features associated with different cell types are identified.

In one embodiment, the antenna includes a number of cells that are controlled through a direct drive control system. The direct drive control system generates controls signals for each cell. In one embodiment, each cell comprise an LC cell and a switch at each cell selectively passes a voltage to the cell based on the control signals from the direct drive control system. In one embodiment, the switch comprises a transistor (e.g., a thin film transistor (TFT)) that selectively passes an alternating current (AC) or ground (GND) voltage to the LC cell to generate the AC LC cell voltage. This is in contrast to a DC direct drive system that generates the voltage on the LC cell by switching the positive DC and negative DC voltage onto the LC capacitance.

In one embodiment, the direct drive control system comprises a matrix drive configuration. This type of direct drive reduces the matrix update rate and eliminates the need for storage capacitance, thus allowing higher drive frequencies. This can be accomplished if each cell has local memory to determine whether the cell is ON or OFF.

Figure 1:
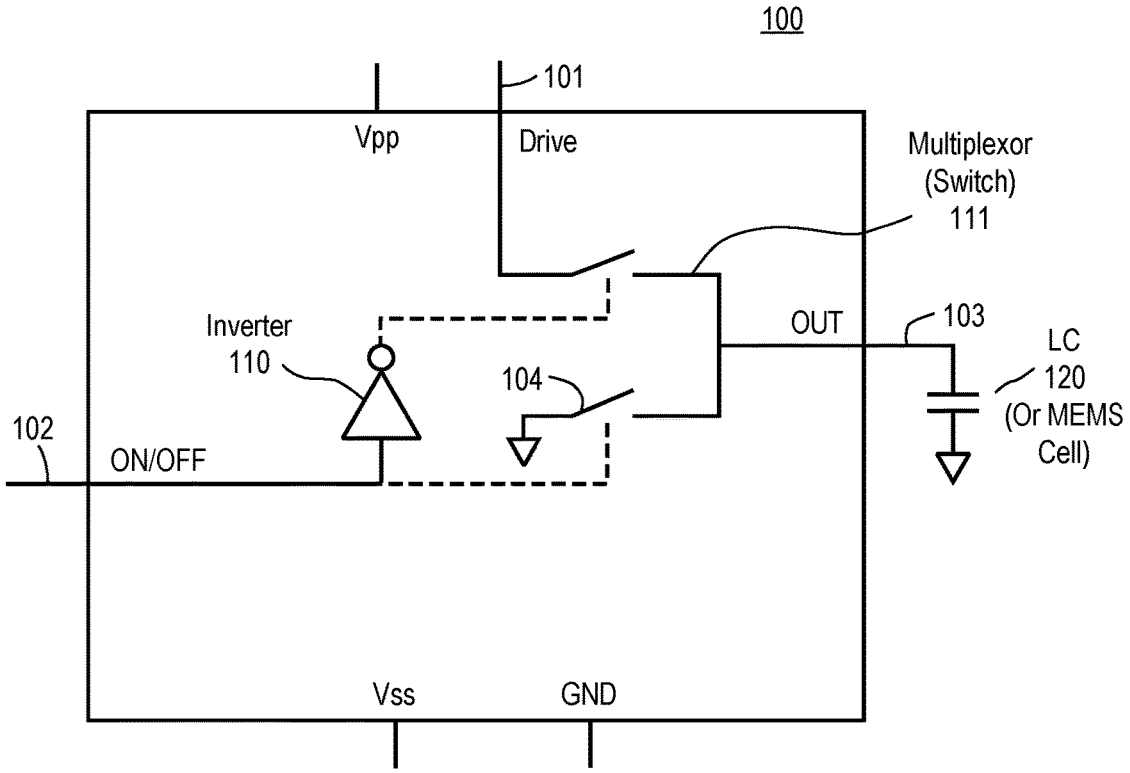
FIG. 1 illustrates one embodiment of a cell driver.

FIG. 1 is a block diagram of one embodiment of a cell driver. In one embodiment, the cell driver drives an AC voltage onto an LC. In one embodiment, there is one cell driver for each antenna element in an antenna array. Examples of antenna arrays that include the cell driver of FIG. 1 are described in greater detail below. Note that in the following description, LCs are the cells that are being driven by the direct drive control system. However, the direct drive control system may be used to drive other types of cells, including other types of metamaterials.

Referring to FIG. 1, cell driver 100 comprises a multiplexor (mux) 111, or other switch, that is coupled to and controlled by ON/OFF input 102. ON/OFF input 102 is coupled to an input of an inverter 110 as well as mux 111. The output of inverter 110 is coupled to mux 111. Drive input 101 is coupled to one input of mux 111 and ground (GND) 104 is coupled to another input of mux 111. In one embodiment, drive input 101 receives the AC LC drive voltage with the desired voltage and frequency to drive LC 120 to the ON state. In another embodiment, when the cell is a MEMS cell, drive 101 receives a DC MEMS drive voltage with the desired voltage to drive the MEMS to the ON state. This may be DC voltage.

ON/OFF input 102 controls the multiplexing of mux 111, thereby causing it to select GND 104 or drive input 101 to be presented to the output (OUT) 103.

Vpp, GND, and Vss are DC bias voltages used for powering the internal control logic of cell driver 100.

Figure 2:
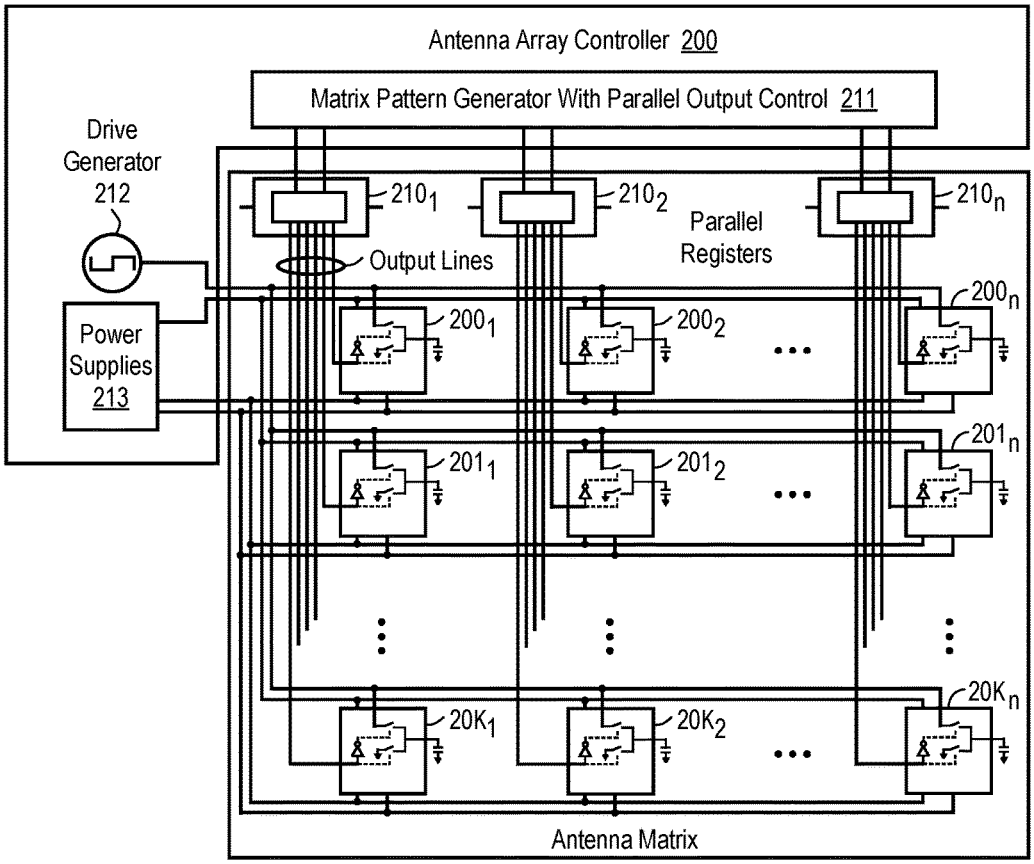
FIG. 2 illustrates an example configuration where the cell drivers are arranged to drive an antenna array.

In one embodiment, the values for the ON/OFF inputs are provided from registers that are controlled by an antenna array controller. FIG. 2 illustrates an example configuration where the cell drivers are arranged to drive an antenna array. Referring to FIG. 2, cell drivers $\mathbf{200}_1$-$\mathbf{200}_n$ through $\mathbf{20}k_1$-$\mathbf{20}k_n$, are Located in rows and columns. Note that while the rows and columns are shown perpendicular to each other, in one embodiment, this matrix configuration is not actually layout in the antenna array and is merely a logical layout for purposes of illustrating direct drive control of a matrix configuration.

In FIG. 2, the control is located at the periphery of the array. The ON/OFF input of each cell driver is individually driven by a register located external to the array of cells. A plurality of parallel registers $\mathbf{210}_1$-$\mathbf{210}_n$ are coupled to and responsive to control signals from a matrix pattern generator 211 to generate parallel output control signals. Matrix pattern generator 211 is part of antenna array controller 200 and generates control signals that cause registers $\mathbf{210}_1$-$\mathbf{210}_n$ to output signals on their output lines for the ON/OFF cell driver inputs. In other words, the matrix pattern generator loads the registers with the values to control which of the cell drivers is ON and which is off at any one moment in time. That is, each of the output lines are coupled to one of the ON/OFF inputs of a cell driver in the array to control the operation of that cell driver.

In one embodiment, the antenna cells are arranged in rings in the antenna array and registers $\mathbf{210}_1$-$\mathbf{210}_n$ are located at the periphery of one of those rings. However, this is not a requirement. In another embodiment, registers $\mathbf{210}_1$-$\mathbf{210}_n$ may be spread out through the array cell drivers based on whether there is space available throughout the antenna array.

Drive generator 212 generates the drive voltage that is coupled to each of the Drive inputs of the cell drivers. In one embodiment, the drive voltage swings between +/−5 volts. However, in other embodiments, other voltage values may be used to drive the LC cells. In another embodiment, the voltage is +/−10V. In one embodiment, the drive voltage is selected based on the chemistry of the LC to get the desired radio-frequency (RF) performance. In one embodiment, the Drive input of all cells is common and is at the desired LC ON voltage and frequency. This net can be broken into sub-nets and driven by multiple drivers if required to meet the desired voltage and frequency due to loading. In other words, if drive generator 212 did not have sufficient drive to drive all the cells, then this net could be broken up into subnets (one net per row for example, or one net for every four rows for another example) and each of these sub-nets could be driven by an individual driver sufficient for the number of cells in that subnet.

In one embodiment, for a MEMS cell, the drive voltage can be a DC voltage of +15V (for example).

In one embodiment, the LC driver frequency and voltage is independent of the array pattern drive update rate. In one embodiment, the pattern update rate is dependent on the rate the peripheral register can be loaded and LC drive frequency is only limited by the switching time of the LC driver multiplexer and LC capacitance, which can be much smaller than a conventional LC active matrix drive.

Note that the LC drive frequency is limited only by the switching time of the LC driver multiplexer (e.g., multiplexer/switch 111) and the LC capacitance.

In one embodiment, power supplies 213 provide the Vpp, Vss and GND voltages to power the logic of the cell driver. In one embodiment, the Vpp of all cells is common and has a DC value equal to or greater than the most positive value of the drive voltage (Vdrive_max). In one embodiment, Vss of all cells is common and has a DC value equal to or less than the most negative value of the drive voltage (Vdrive_min). In one embodiment, Vss is 5V more negative than Vdrive_min needed for its logic configuration. GND of all cells is common and is the same level as the non-driven side of the LC.

The LC driver frequency and voltage can be independent of the array pattern drive update rate. The pattern update rate is dependent on the rate the peripheral register can be loaded and LC drive frequency is only limited by the switching time of the LC driver multiplexer and LC capacitance, which can be much smaller than a conventional LC active matrix drive.

Note that the configuration of FIG. 2, including the parallel control registers, requires a large number of control traces, one for each cell. This could be prohibitive for large array sizes.

Figure 3:
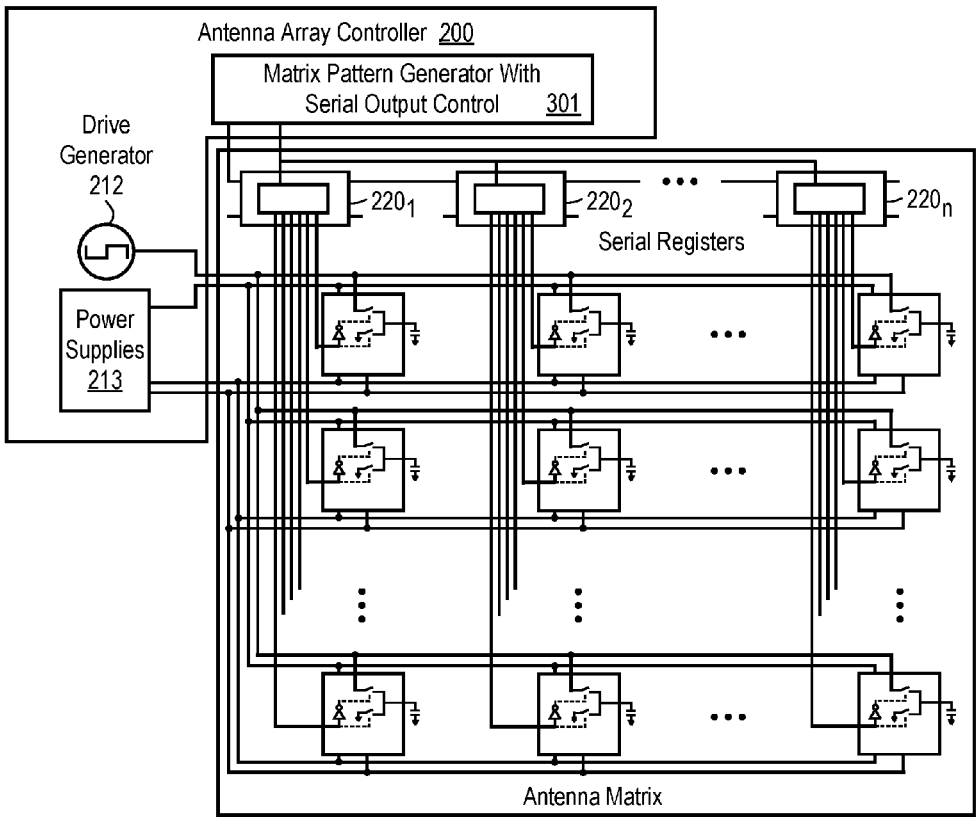
FIG. 3 illustrates one embodiment of an antenna matrix with serial shift registers to control cell drivers.

In one embodiment, the parallel control registers are configured as a number of serial shift registers in a matrix configuration. FIG. 3 illustrates an antenna matrix with serial shift registers to control cell drivers. Referring to FIG. 3, serial shift registers $\mathbf{220}_1$-$\mathbf{220}_n$ are coupled together, with the Dout of one serial shift register supplying the Din input for the next serial shift register in the chain. The Din of the first serial shift register is coupled to an output of matrix pattern generator 301, which represents the generated control pattern for the antenna. Matrix pattern generator 301 need load only the first serial shift register and propagate the values through the serial chain of shift registers instead of having a set of parallel lines, one for each register, that were used to load the data in parallel. Matrix pattern generator 301 also is coupled via a control signal to all the serial shift registers $\mathbf{220}_1$-$\mathbf{220}_n$.

In one embodiment, the serial shift registers reduce the number of traces between antenna array controller 200 and the antenna matrix. In FIG. 2, the number of traces between 211 and $\mathbf{210}_1$ and $\mathbf{210}_n$ is equal to the number of cells in the array plus a number of traces to load and control $\mathbf{210}_1$ through $\mathbf{210}_n$. This number can be from 1 to n, depending on the implementation. However, in FIG. 3, the number of traces between 301 and $\mathbf{220}_1$ through $\mathbf{220}_n$ can be as low as one for data and one for a clock. In practice, there may be a couple more signals to synchronize array pattern changes.

Figure 4:
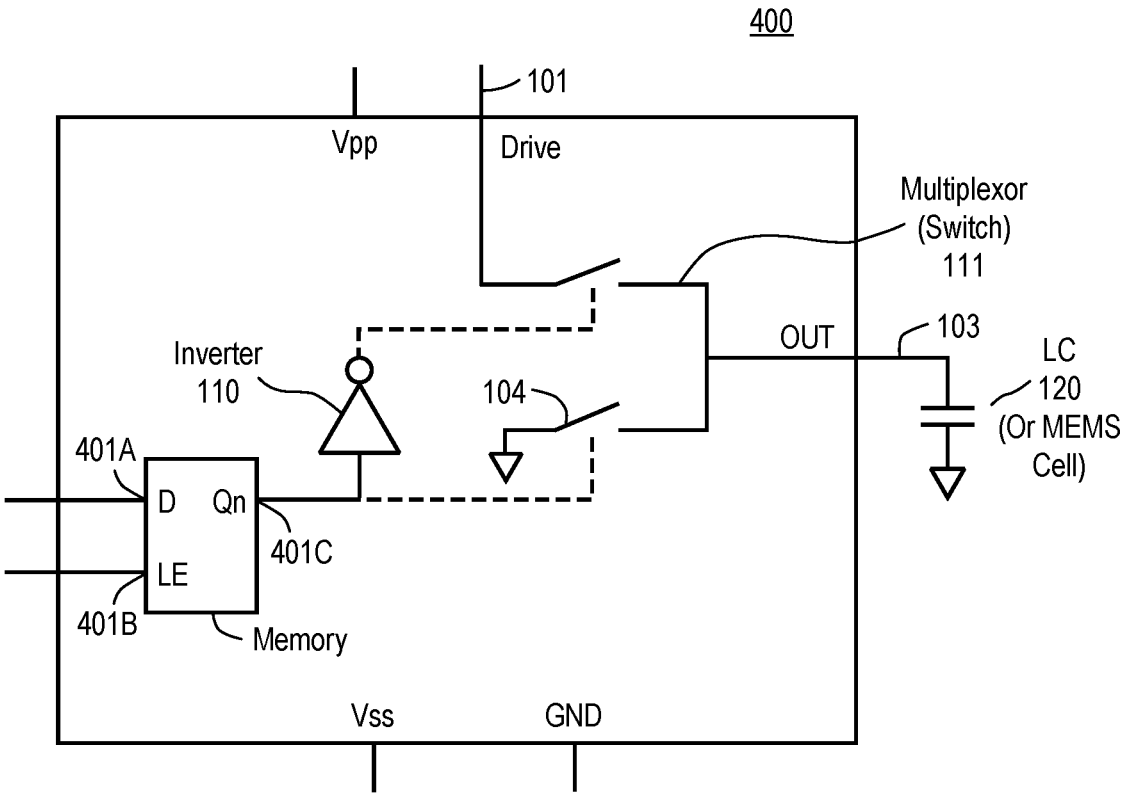
FIG. 4 is a block diagram of one embodiment of a cell driver that includes local memory.

Another technique to reduce the number of control traces is to relocate the peripheral register into the cell driver. FIG. 4 is a block diagram of one embodiment of a cell driver that includes local memory. Referring to FIG. 4, cell driver 400 has a drive input 101 that is driven with the AC LC drive voltage with the desired voltage and frequency to drive the LC to the ON state. Memory 401 stores that data that is used to provide the ON/OFF signal that controls multiplexor 111 to output either the drive voltage from drive input 101 or the ground voltage 104 onto OUT 103 that is coupled to LC 120. In one embodiment, memory 401 comprises a latch. The D(data) input 401A of the latch is the input and is clock in by LE (latch enable) input 401B. The Qn output 401C of the latch controls the switching of mux 111 to select which input is presented to OUT 103. In one embodiment, memory 401 (e.g., latch) is written only when the cell needs to change from one state to another.

Similar to the cell driver of FIG. 1, Vpp, GND, and Vss are DC bias voltage used for powering the internal control logic of the cell driver.

Figure 5:
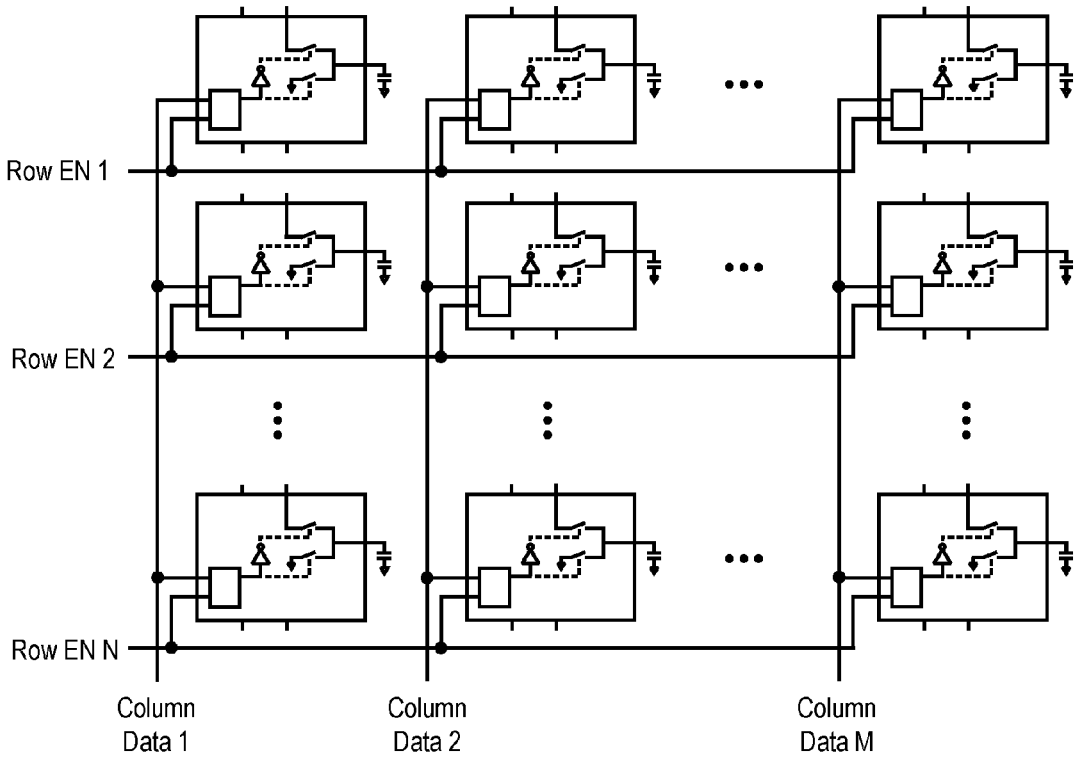
FIG. 5 illustrates one embodiment of a matrix configuration in which cell drivers are arranged in a matrix.

FIG. 5 shows one embodiment of a matrix configuration in which cell drivers are arranged in a matrix. Referring to FIG. 5, the D input of all cell drivers in each column is common and is driven by the column driver for that column. For example, all the cell drivers in the first column are driven by the Column Data 1 signal, all the cell drivers in the second column are driven by the Column Data 2 signal, and all the cell drivers in the Mth column are driven by the Column Data M signal. The LE input of all cell drivers in each row is common and is driven by the row driver for that row. For example, the LE input for the cell drivers in row 1 is driven by the Row EN 1 signal, the LE input for the cell drivers in row 2 is driven by the Row EN 2 signal, and the LE input for the cell drivers in row N is driven by the Row EN N signal. The Drive input of all cells is common and is at the desired LC ON voltage and frequency. This net can be broken into sub-nets and driven by multiple drivers if required to meet the desired voltage and frequency due to loading.

In one embodiment, in this configuration, the Vpp of all cells is common and has a DC value equal to or greater than the most positive value of the drive voltage (Vdrive_max). In one embodiment, the Vss of all cells is common and has a DC value equal to or less than the most negative value of the drive voltage (Vdrive_min). In one embodiment, Vss is 5V more negative than Vdrive_min needed for its logic configuration. In one embodiment, GND of all cells is common and is the same level as the non-driven side of the LC.

In one embodiment, the cell drivers are programmed every time a new clock occurs. This indicates whether an LC cell will be ON or OFF. Whenever the pattern changes the cell drivers can be updated. To update the entire matrix of cell drivers, the antenna array controller implements the algorithm below to update the matrix. As part of the algorithm, all the values from the control registers are initially set to either ON or OFF using the Column Data signals, and then a row of cell drivers are clocked using a Row EN signal, which allows the data to be read in and control the cell driver. Then the data for the next row of cell drivers is programmed out of the column data on the Column Data signals, and the next row of cell drivers is enabled to read in that data. This proceeds until all the rows in the entire antenna array have been programmed/updated during a frame.

One embodiment of an algorithm to update this matrix is as follows:

1. On each Column Data x net, set the Row 1 value. This will be a high to pass the drive voltage VDrive to the cell driver output OUT or a low to pass GND to the cell driver output OUT.
2. Clock data into row of latches. Bring Row EN 1 high, delay (e.g., 10 uS), bring Row EN 1 low.
3. On each Column Data x net set the value for the next Row.
4. Clock data into the next row of latches (in the cell drivers in that row).
5. Repeat steps 3 & 4 for all rows.
6. Determine next frame pattern, then repeat 1 thru 6.

With a 10 uS latch enable time, a 180 row matrix would have a frame rate of less than 20 mS. In one embodiment, the LC drive frequency is not dependent on the number of rows, but limited by the slew rate and drive of the voltage drive VDrive input and the load capacitance. Thus, this architecture decouples the LC drive frequency from the matrix update rate.

One advantage to this architecture is that the cell driver structure in the matrix memory configuration reduces the requirement to have to cycle through the matrix at a rate of two time the LC drive frequency (e.g., 2 kHz) to once per frame (20 ms=>50 Hz).

Another advantage is that there is no requirement for a cell storage capacitor, because the cell is directly driven (through the cell driver ON FET e.g., M5 in FIG. 7, multiplexer 111 in FIG. 4)). This helps decrease the charge time of the cell and helps increase the LC drive frequency.

Figure 18:
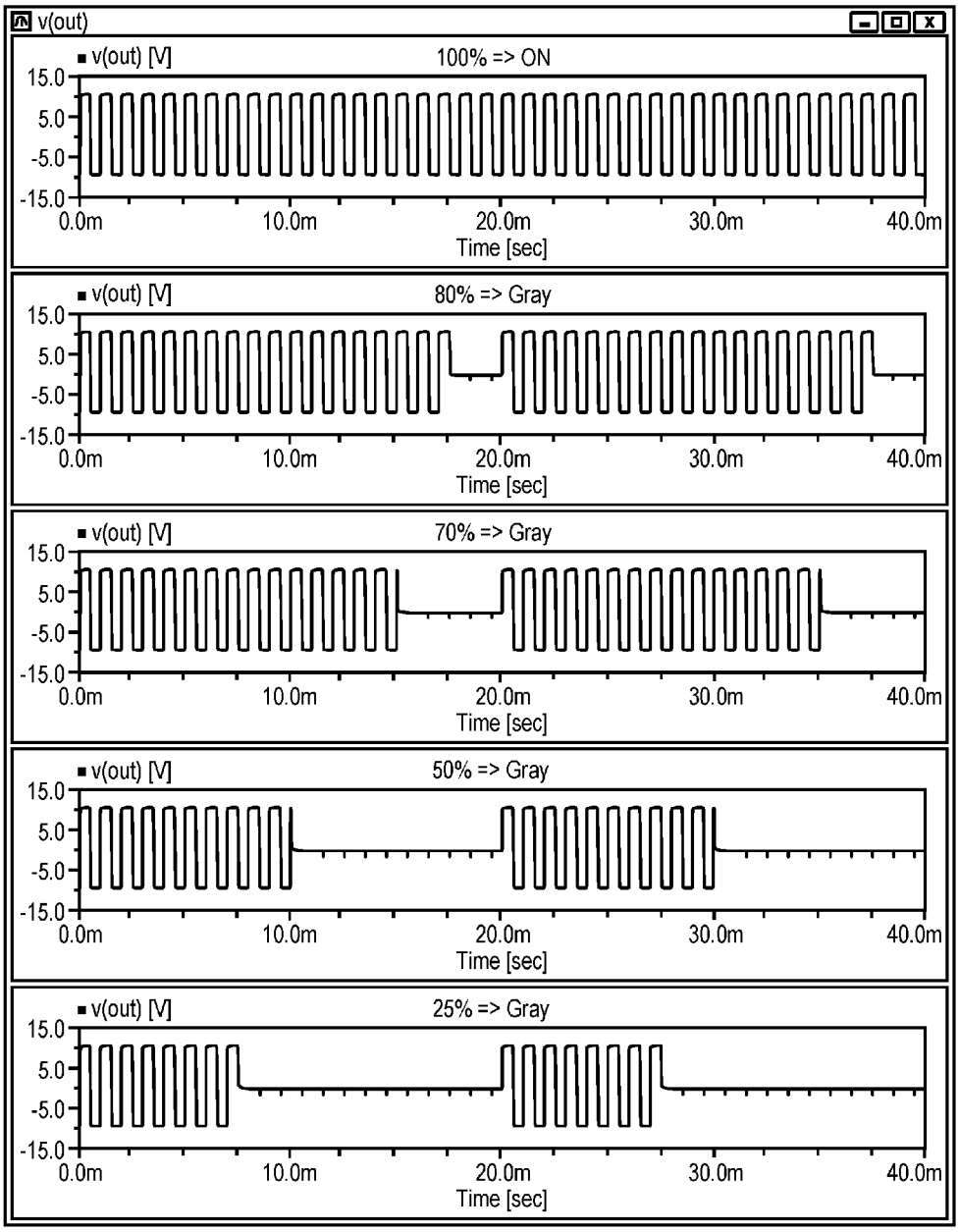
FIG. 18 illustrates frame times of various voltage waveforms applied across a liquid crystal to achieve PWM gray shading.
Figure 18:
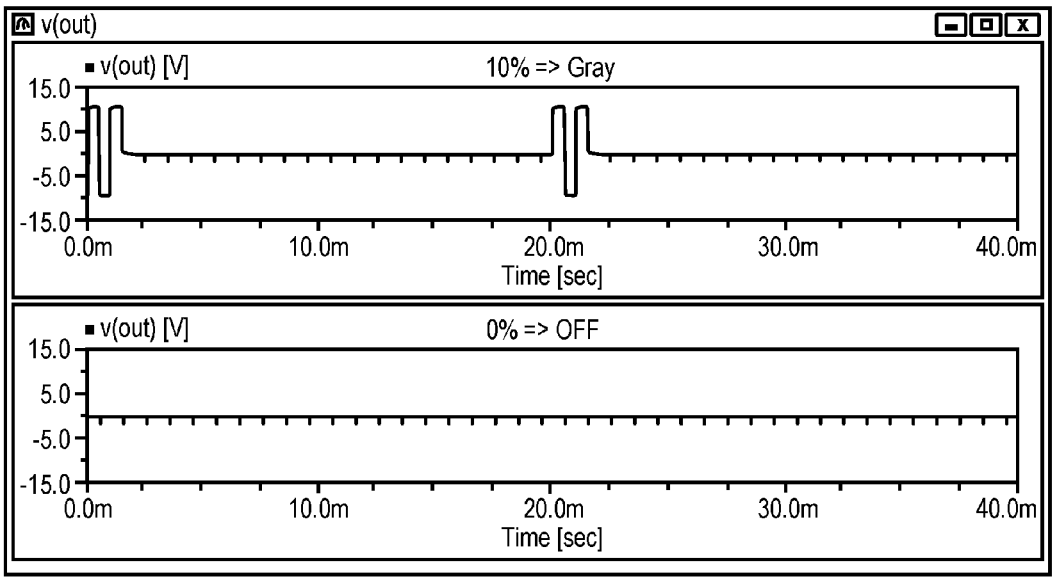

This arrangement presents some limitations. When the drive voltage Vdrive is common to all the cells (or all the cells in a Vdrive sub-net), individual cells cannot have different gray shades generated by different voltage levels of the drive voltage Vdrive. That is, the cell drivers are either ON or OFF, allowing the LC to be driven by the AC voltage or driven by GND. It may be possible to have individual gray shades by using a pulse width modulation (PWM) method with a resolution defined by the frame rate. In one embodiment, a gray shading technique is used in which the cells can be turned on for shorter periods of time and then left off for longer periods of time so it doesn't appear the cells are either ON or OFF. If the frames are fast enough, a PWM gray pattern could control the amount of time the cell drivers are ON and OFF, and depending on the ratio of oscillation between the on-off switching, a different level of gray shade can be achieved. More specifically, FIG. 18 shows two frame times of various voltage waveforms applied across the LC that would achieve PWM gray shading. Referring to FIG. 18, the top pane shows the voltage waveform for a fully ON cell, while the bottom pane shows the voltage waveform for a fully OFF cell. The other panes show the waveforms for gray shades where the shade is based on the ratio of the time that the voltage is oscillating (ON) versus the time that it is at zero volts (OFF). The granularly of the different shades of gray will depend on the rate at the cell can change ON and OFF states in relation to the frame OFF states in relation to the frame time, where the frame time is the time the matrix pattern need to change.

Note that the PWM described above maybe used with a MEMS cell to achieve gray shades by incorporating additional cell drivers.

Figure 6:
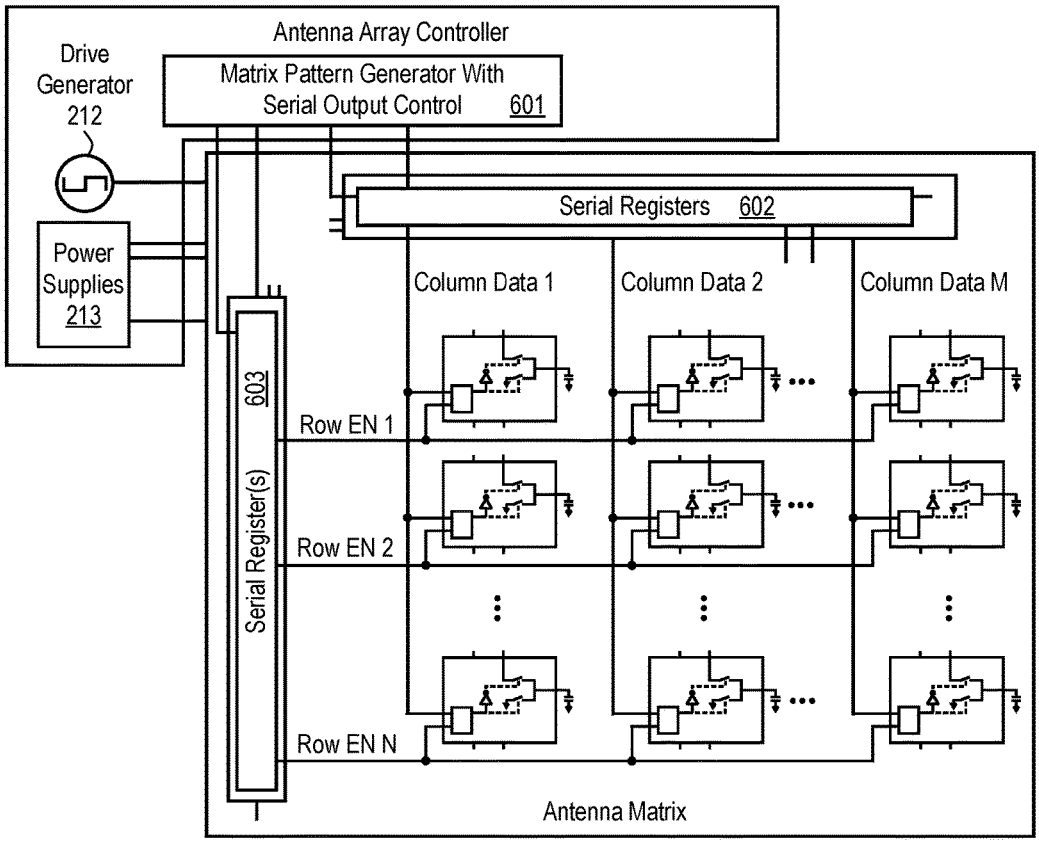
FIG. 6 illustrates another embodiment of an antenna matrix with serial shift registers to control cell drivers.

FIG. 6 illustrates an antenna matrix that is controlled with one or more serial register(s). Referring to FIG. 6, a matrix pattern generator 601 with a serial output control provides input data to serial register(s) 602. Serial register(s) 602 have outputs, which are control signals, coupled to the Column Data 1-M signals that are coupled to D(data) inputs of the latches in the cell drivers. Also, the matrix pattern generator 601 provides input data to serial register(s) 603. Serial register(s) 603 have outputs, which are control signals, coupled to the Row EN 1-N signals that are coupled to LE inputs of the latches in the cell drivers. Matrix pattern generator 601 provides the drive pattern to serial registers serially and based on the Row EN signals, one row of cell drivers latch the data at one time.

Figure 7:
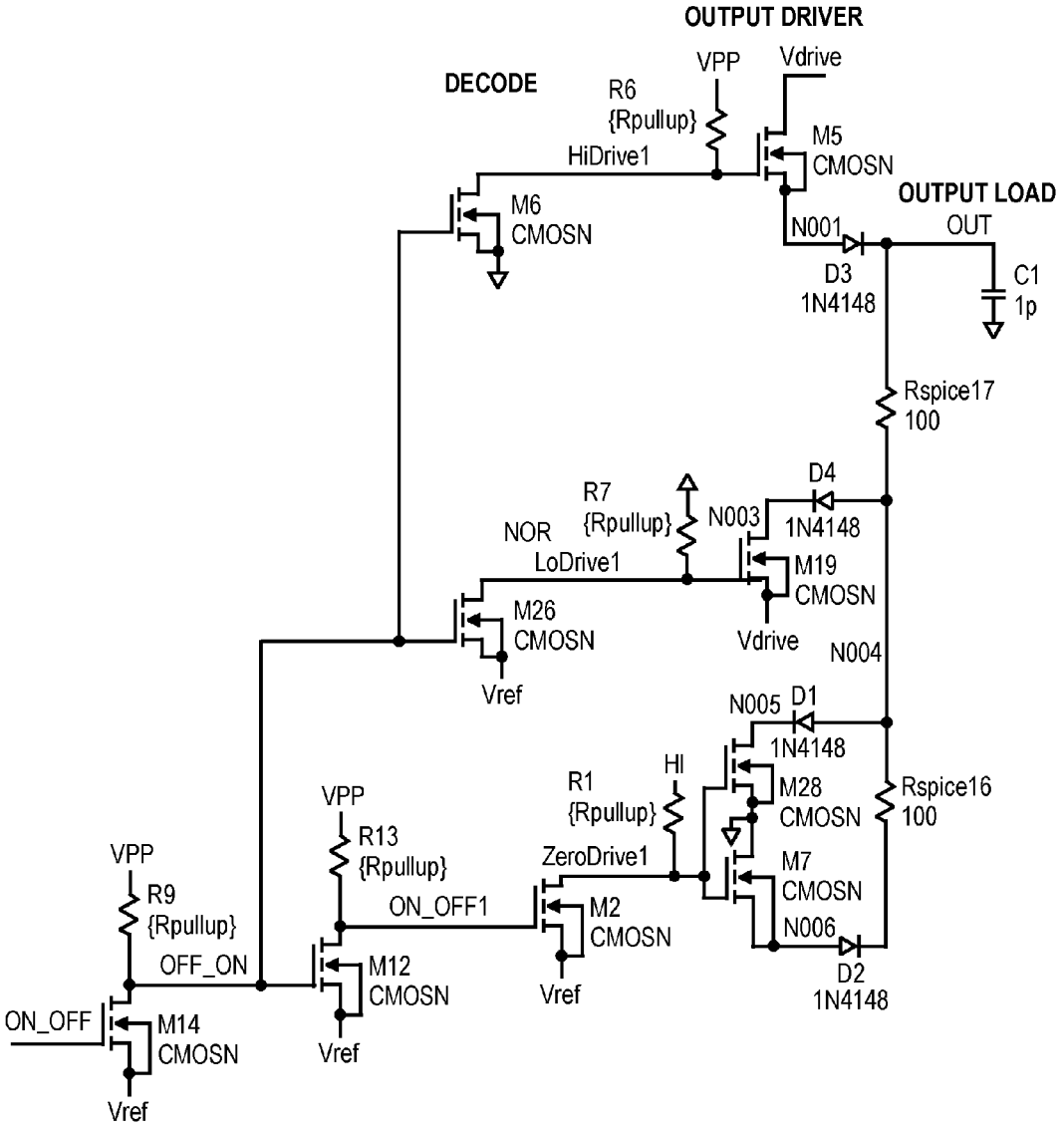
FIG. 7 illustrates one embodiment of a circuit schematic of one embodiment of decode and output driver.
Figure 8:
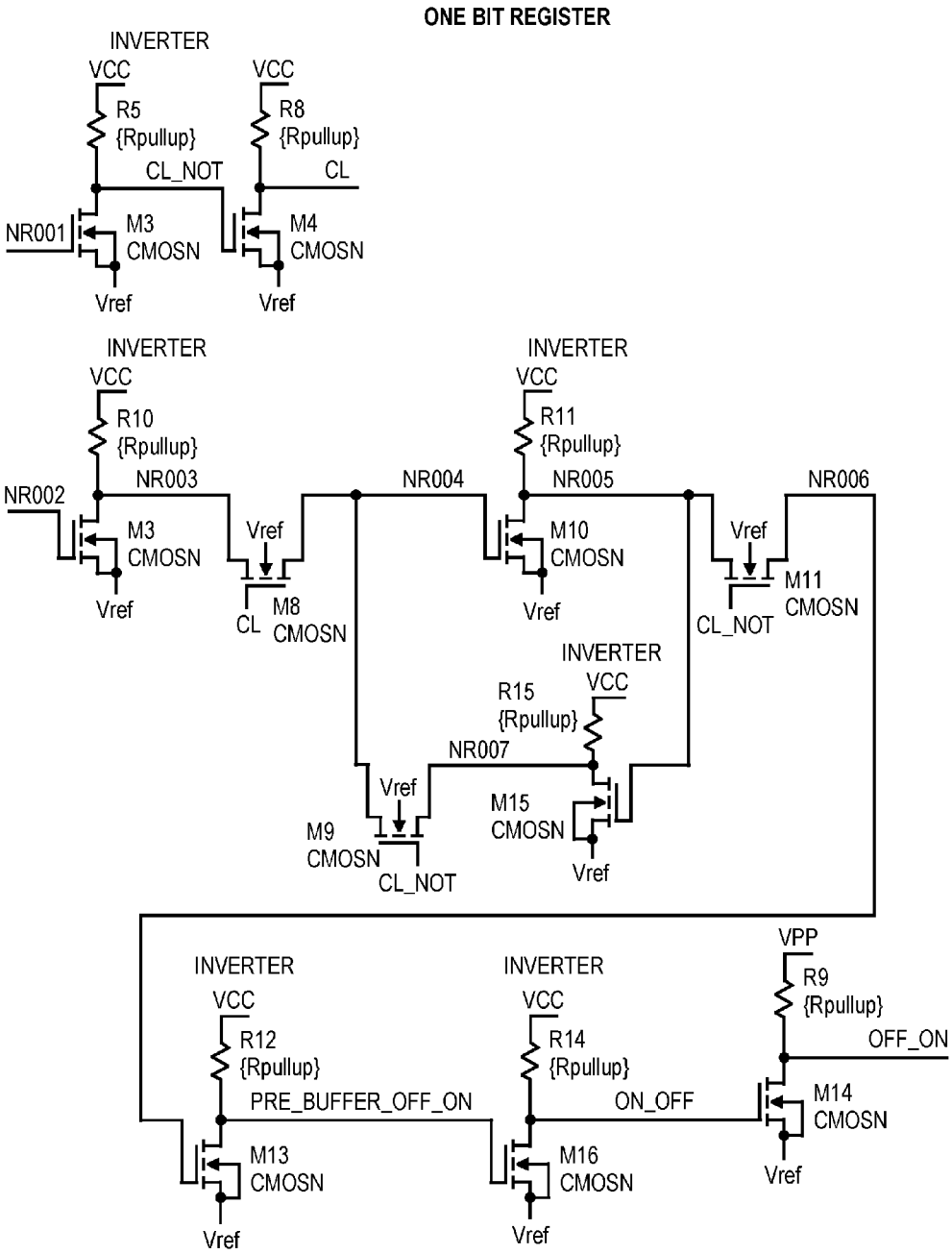
FIG. 8 illustrates one embodiment of a cell driver schematic with a bi-stable one bit register.
Figure 9:
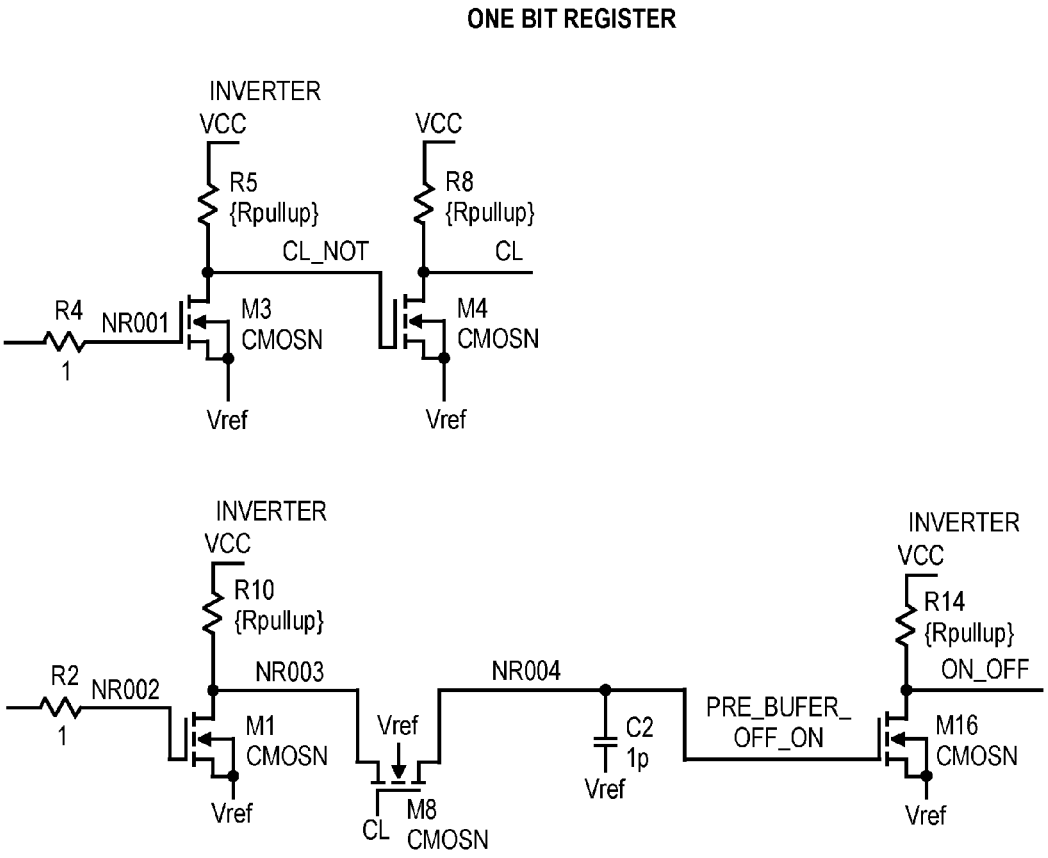
FIG. 9 illustrates one embodiment of a cell driver schematic with capacitor one bit register.

FIGS. 7-9 illustrates examples of circuit schematics to perform cell driver functions. FIG. 7 illustrates a circuit schematic of one embodiment of decode and output driver. The circuit acts as a level shifter enabling the input control voltage to be different from the output voltages. If transistors M5 or M19 are on, the drive voltage Vdrive is output. This will be triggered by the ON_OFF signals at the input of the circuit proceeding through an inverter that controls the output of the multiplexing switch. Note that there are two paths that drive the output when the AC drive voltage is switched to the output, through both transistors M5 and M19. This is because the AC signal has both positive and negative portions and the two paths ensure that the LC is always driven high when the AC drive signal is selected to be output from the multiplexing switch. The other portion of the circuit clamps the output to ground when the ON_OFF signal indicates that the output of the multiplexing switch should be grounded.

FIGS. 8 and 9 illustrate two different configurations of cell driver schematics that include a latch memory to hold the ON/OFF state of the cell driver. More specifically, FIG. 8 is a bi-stable configuration. Referring to FIG. 8, the first one bit register is for the clock signal (LE), while the second circuit is for the flip-flop, or latch. The clock circuit includes the memory portion followed by waving shaping and amplification to get the voltage level up to perform control. The D input circuit includes a register and uses positive feedback to latch in the data value. FIG. 9 illustrates another embodiment of the cell driver circuits that include a capacitor one bit register. This configuration uses less TFTs and incorporates a capacitor to store the ON/OFF state. Note that there are also three less inverter stages.

| Level shift and output multiplexing switches | |
|---|---|
| M12 | Inverter shown in FIG. 7 |
| M2, M7, M28 | Level shifter and drive transistors for when the output is to be driven to GND |
| M26, M19 | Level shifter and drive transistor for when the output is to be driven negative |
| M6, M5 | Level shifter and drive transistor for when the output is to be driven positive |
| D1-D4 | Diodes to prevent back current when transistors are back biased |

| Bi-Stable One Bit Register | |
|---|---|
| M3 and M4 | Input buffer and inverter for the for the register clock (LE in FIG. 8) |
| M1 | Input buffer for the register data (D in FIG. 8) |
| M8 | Input gate to the register |
| M10 | Inverting buffer |
| M15 | Feedback buffer |
| M9 | Feedback gate |
| M11 | Output gate |
| M9, M13, M16 | Buffers to clean up the register output signal |

| Capacitor One Bit Register | |
|---|---|
| M3 and M4 | Input buffer and inverter for the register clock (LE in FIG. 9) |
| M1 | Input buffer for the register data (D in FIG. 9) |
| M8 | Input gate to the register |
| C2 | Memory storage capacitor |
| M16 | Output gate |

The operation of the circuits in FIGS. 7-9 would be well understood by those skilled in the art.

Figure 10:
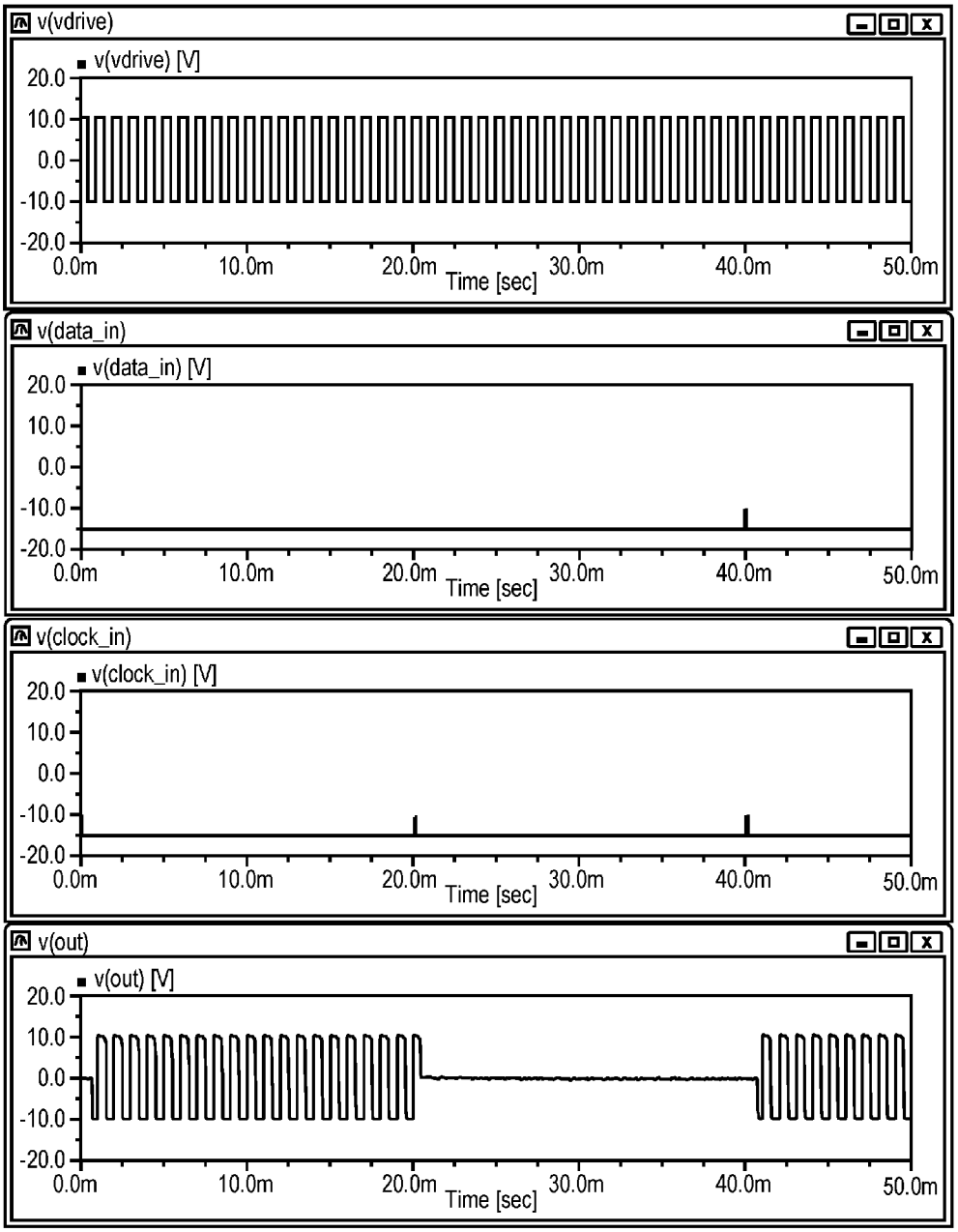
FIG. 10 illustrates example output voltage plots.

FIG. 10 shows details of a simulation of the circuits of FIGS. 7-9. Referring to FIG. 10, the top pane of FIG. 10 shows the 1 KHz, 10 Vrms input signal Vdrive applied to the DRIVE input. Note that other voltages can be used.

The second pane in FIG. 10 illustrates the data input (D) to the cell. In the matrix configuration shown in FIG. 5, this would represent the turning ON of this cell in this column of Row 1 for alternating "frames" and OFF for the other frames, where the time per frame is 20 ms.

The third pane in FIG. 10 shows the clock (LE) of the cell. In the matrix configuration shown in FIG. 5, this represents clocking of the data every 20 ms frame.

In one embodiment, the pulse width of the clock and data are set at 10 uS, which is long enough to latch the data into the register with TFT transistor models used. Other times could be used, and are dependent on the design of the TFT. Times shorter than this did not reliably register the data. This is also short enough (with no margin) to update 200 matrix rows within the 20 ms frame time.

The fourth pane in FIG. 9 is the OUT signal of the cell driver, which drives the LC cell. It shows a 1 KHz 10 Vrms signal alternate ON and OFF (GND) every other 20 ms frame.

Examples of Antenna Embodiments

The techniques described above may be used with flat panel antennas. Embodiments of such flat panel antennas are disclosed. The flat panel antennas include one or more arrays of antenna elements on an antenna aperture. In one embodiment, the antenna elements comprise liquid crystal cells. In one embodiment, the flat panel antenna is a cylindrically fed antenna that includes matrix drive circuitry to uniquely address and drive each of the antenna elements that are not placed in rows and columns. In one embodiment, the elements are placed in rings.

In one embodiment, the antenna aperture having the one or more arrays of antenna elements is comprised of multiple segments coupled together. When coupled together, the combination of the segments form closed concentric rings of antenna elements. In one embodiment, the concentric rings are concentric with respect to the antenna feed.

Overview of an Examples of Antenna Systems

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Examples of Wave Guiding Structures

Figure 11A:
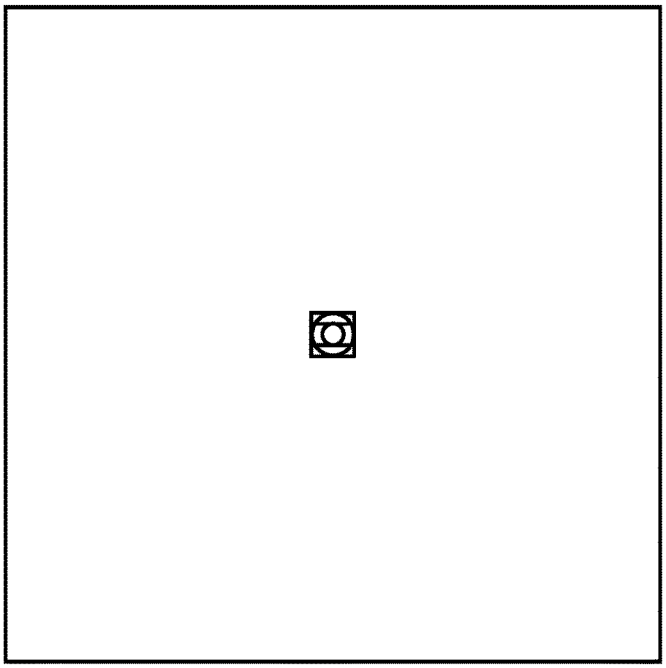
FIG. 11A illustrates a top view of one embodiment of a coaxial feed that is used to provide a cylindrical wave feed.

FIG. 11A illustrates a top view of one embodiment of a coaxial feed that is used to provide a cylindrical wave feed. Referring to FIG. 11A, the coaxial feed includes a center conductor and an outer conductor. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

Figure 11B:
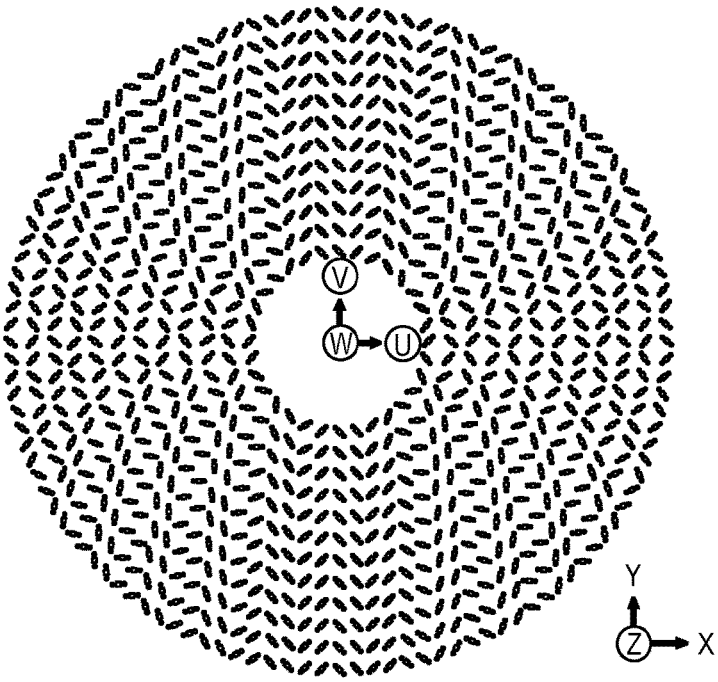
FIG. 11B illustrates an aperture having one or more arrays of antenna elements placed in concentric rings around an input feed of the cylindrically fed antenna.

FIG. 11B illustrates an aperture having one or more arrays of antenna elements placed in concentric rings around an input feed of the cylindrically fed antenna.

Antenna Elements

In one embodiment, the antenna elements comprise a group of patch antennas. This group of patch antennas comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is disposed in the gap around the scattering element. This LC is driven by the direct drive embodiments described above. In one embodiment, liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty five degree (45°) angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation if controlled to the same tuning state. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, as discussed above, a matrix drive is used to apply voltage to the patches in order to drive each cell separately from all the other cells without having a separate connection for each cell (direct drive). Because of the high density of elements, the matrix drive is an efficient way to address each cell individually.

In one embodiment, the control structure for the antenna system has 2 main components: the antenna array controller, which includes drive electronics, for the antenna system, is below the wave scattering structure, while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude or duty cycle of an AC bias signal to that element.

In one embodiment, the antenna array controller also contains a microprocessor executing the software. The control structure may also incorporate sensors (e.g., a GPS receiver, a three axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the antenna array controller controls which elements are turned off and those elements turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 12:
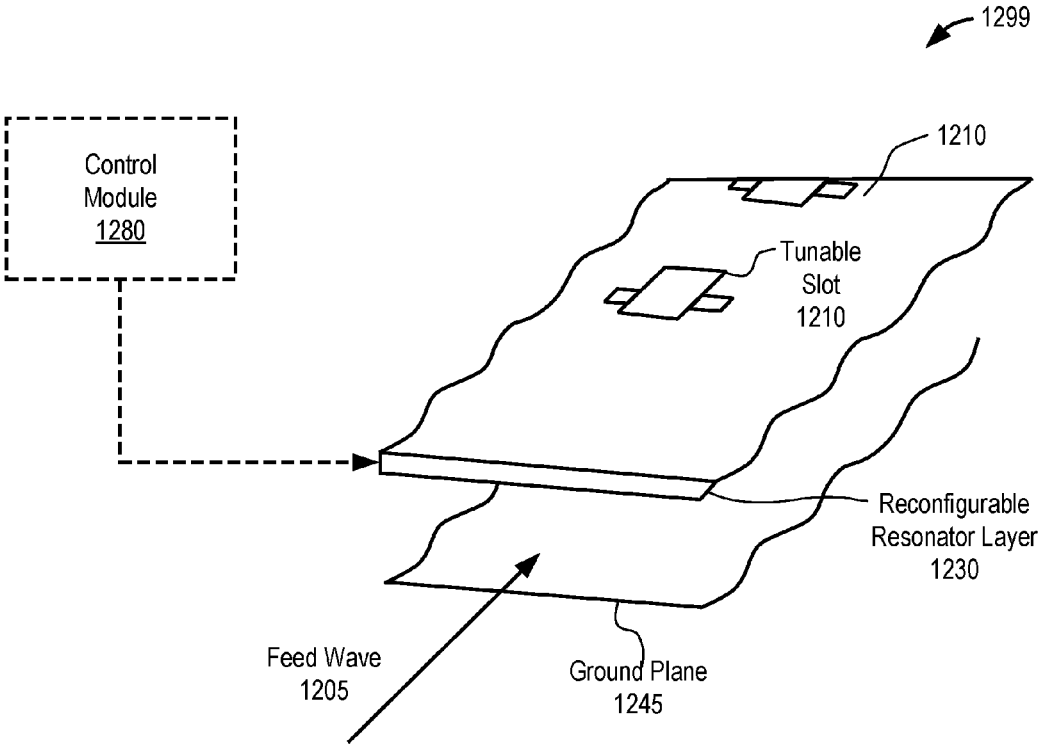
FIG. 12 illustrates a perspective view of one row of antenna elements that includes a ground plane and a reconfigurable resonator layer.

FIG. 12 illustrates a perspective view of one row of antenna elements that includes a ground plane and a reconfigurable resonator layer. Reconfigurable resonator layer 1230 includes an array of tunable slots 1210. The array of tunable slots 1210 can be configured to point the antenna in a desired direction. Each of the tunable slots can be tuned/adjusted by varying a voltage across the liquid crystal.

Control module 1280 is coupled to reconfigurable resonator layer 1230 to modulate the array of tunable slots 1210 by varying the voltage across the liquid crystal in FIG. 12. Control module 1280 may include a Field Programmable Gate Array ("FPGA"), a microprocessor, a controller, System-on-a-Chip (SoC), or other processing logic. In one embodiment, control module 1280 includes logic circuitry (e.g., multiplexer) to drive the array of tunable slots 1210. In one embodiment, control module 1280 receives data that includes specifications for a holographic diffraction pattern to be driven onto the array of tunable slots 1210. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 1280 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 1205 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 1210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w^*_{in}w_{out}$, with $w_{in}$ as the wave equation in the waveguide and $w_{out}$ the wave equation on the outgoing wave.

Figure 13:
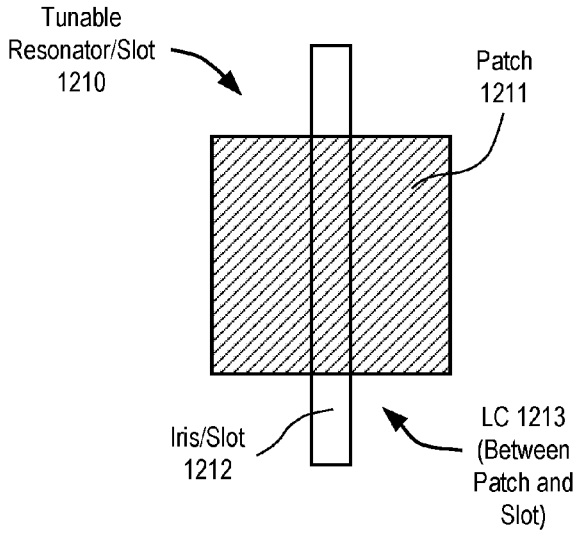
FIG. 13 illustrates one embodiment of a tunable resonator/slot.

FIG. 13 illustrates one embodiment of a tunable resonator/slot 1210. Tunable slot 1210 includes an iris/slot 1212, a radiating patch 1211, and liquid crystal 1213 disposed between iris 1212 and patch 1211. In one embodiment, radiating patch 1211 is co-located with iris 1212.

Figure 14:
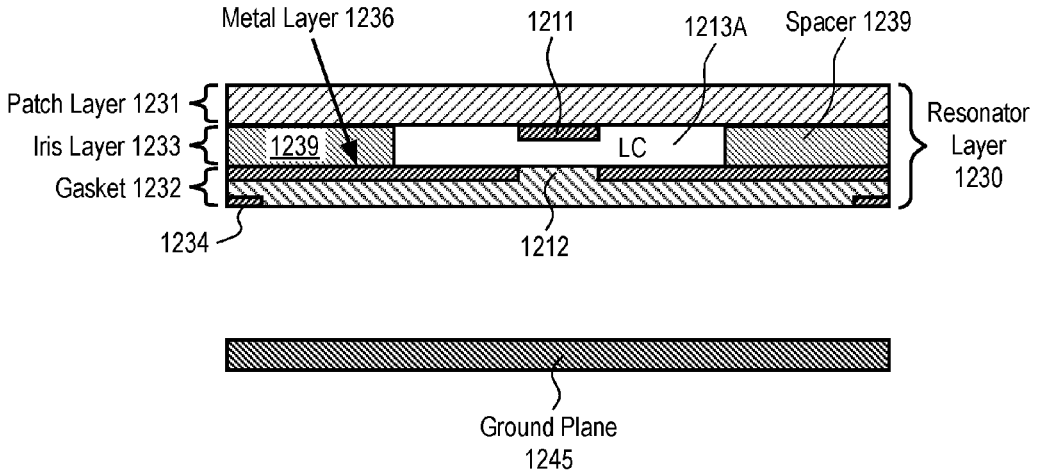
FIG. 14 illustrates a cross section view of one embodiment of a physical antenna aperture.

FIG. 14 illustrates a cross section view of one embodiment of a physical antenna aperture. The antenna aperture includes ground plane 1245, and a metal layer 1236 within iris layer 1233, which is included in reconfigurable resonator layer 1230. In one embodiment, the antenna aperture of FIG.

14 includes a plurality of tunable resonator/slots 1210 of FIG. 13. Iris/slot 1212 is defined by openings in metal layer 1236. A feed wave, such as feed wave 1205 of FIG. 12, may have a microwave frequency compatible with satellite communication channels. The feed wave propagates between ground plane 1245 and resonator layer 1230.

Reconfigurable resonator layer 1230 also includes gasket layer 1232 and patch layer 1231. Gasket layer 1232 is disposed below patch layer 1231 and iris layer 1233. Note that in one embodiment, a spacer could replace gasket layer 1232. In one embodiment, iris layer 1233 is a printed circuit board ("PCB") that includes a copper layer as metal layer 1236. In one embodiment, iris layer 1233 is glass. Iris layer 1233 may be other types of substrates.

Openings may be etched in the copper layer to form slots 1212. In one embodiment, iris layer 1233 is conductively coupled by a conductive bonding layer to another structure (e.g., a waveguide) in FIG. 14. Note that in an embodiment the iris layer is not conductively coupled by a conductive bonding layer and is instead interfaced with a non-conducting bonding layer.

Patch layer 1231 may also be a PCB that includes metal as radiating patches 1211. In one embodiment, gasket layer 1232 includes spacers 1239 that provide a mechanical standoff to define the dimension between metal layer 1236 and patch 1211. In one embodiment, the spacers are 75 microns, but other sizes may be used (e.g., 3-200 mm). As mentioned above, in one embodiment, the antenna aperture of FIG. 4 includes multiple tunable resonator/slots, such as tunable resonator/slot 1210 includes patch 1211, liquid crystal 1213, and iris 1212 of FIG. 13. The chamber for liquid crystal 1213 is defined by spacers 1239, iris layer 1233 and metal layer 1236. When the chamber is filled with liquid crystal, patch layer 1231 can be laminated onto spacers 1239 to seal liquid crystal within resonator layer 1230.

A voltage between patch layer 1231 and iris layer 1233 can be modulated to tune the liquid crystal in the gap between the patch and the slots (e.g., tunable resonator/slot 1210). Adjusting the voltage across liquid crystal 1213 varies the capacitance of a slot (e.g., tunable resonator/slot 1210). Accordingly, the reactance of a slot (e.g., tunable resonator/slot 1210) can be varied by changing the capacitance. Resonant frequency of slot 1210 also changes according to the equation $$f = \frac{1}{2\pi\sqrt{LC}}$$

where f is the resonant frequency of slot 1210 and L and C are the inductance and capacitance of slot 1210, respectively. The resonant frequency of slot 1210 affects the energy radiated from feed wave 1205 propagating through the waveguide. As an example, if feed wave 1205 is 20 GHz, the resonant frequency of a slot 1210 may be adjusted (by varying the capacitance) to 17 GHz so that the slot 1210 couples substantially no energy from feed wave 1205. Or, the resonant frequency of a slot 1210 may be adjusted to 20 GHz so that the slot 1210 couples energy from feed wave 1205 and radiates that energy into free space. Although the examples given are binary (fully radiating or not radiating at all), full gray scale control of the reactance, and therefore the resonant frequency of slot 1210 is possible with voltage variance over a multi-valued range. Hence, the energy radiated from each slot 1210 can be finely controlled so that detailed holographic diffraction patterns can be formed by the array of tunable slots.

In one embodiment, tunable slots in a row are spaced from each other by λ/5. Other spacings may be used. In one embodiment, each tunable slot in a row is spaced from the closest tunable slot in an adjacent row by λ/2, and, thus, commonly oriented tunable slots in different rows are spaced by λ/4, though other spacings are possible (e.g., λ/5, λ/6.3). In another embodiment, each tunable slot in a row is spaced from the closest tunable slot in an adjacent row by λ/3.

Embodiments use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015.

FIGS. 15A-D illustrate one embodiment of the different layers for creating the slotted array. The antenna array includes antenna elements that are positioned in rings, such as the example rings shown in FIG. 11B. Note that in this example the antenna array has two different types of antenna elements that are used for two different types of frequency bands.

Figure 15A:
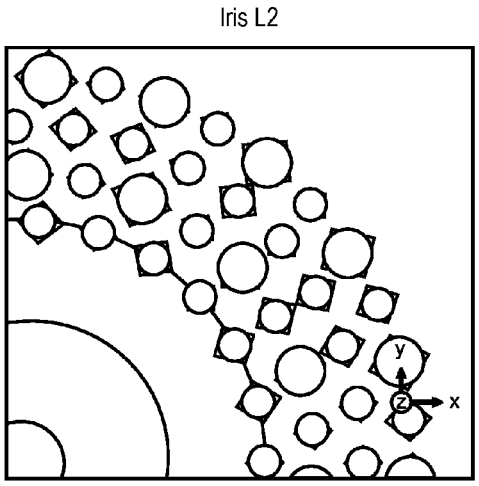
FIGS. 15A-D illustrate one embodiment of the different layers for creating the slotted array.
Figure 15B:
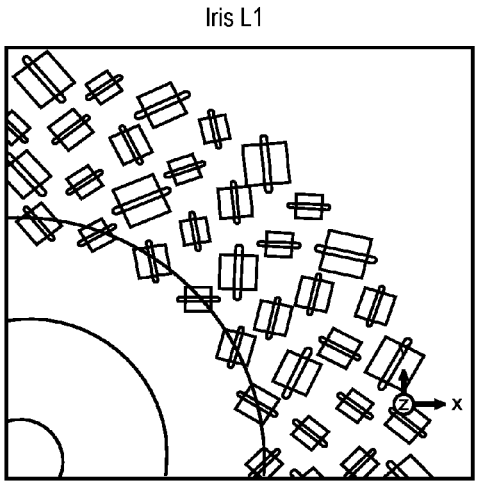
Figure 15C:
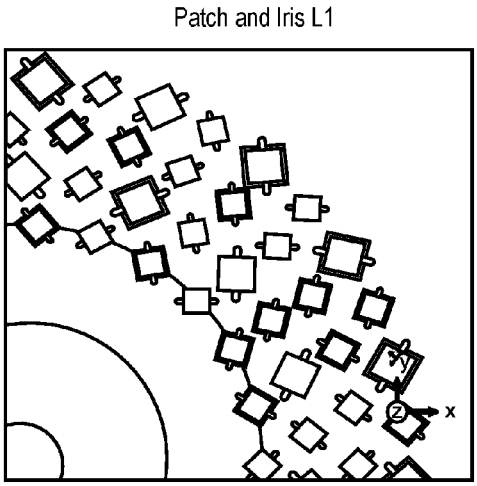
Figure 15D:
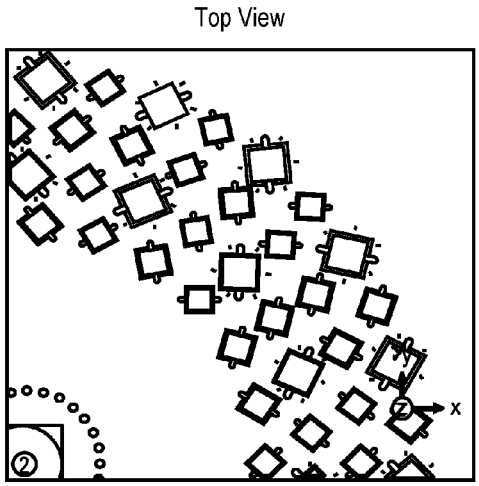

FIG. 15A illustrates a portion of the first iris board layer with locations corresponding to the slots. Referring to FIG. 15A, the circles are open areas/slots in the metallization in the bottom side of the iris substrate, and are for controlling the coupling of elements to the feed (the feed wave). Note that this layer is an optional layer and is not used in all designs. FIG. 15B illustrates a portion of the second iris board layer containing slots. FIG. 15C illustrates patches over a portion of the second iris board layer. FIG. 15D illustrates a top view of a portion of the slotted array.

Figure 16A:
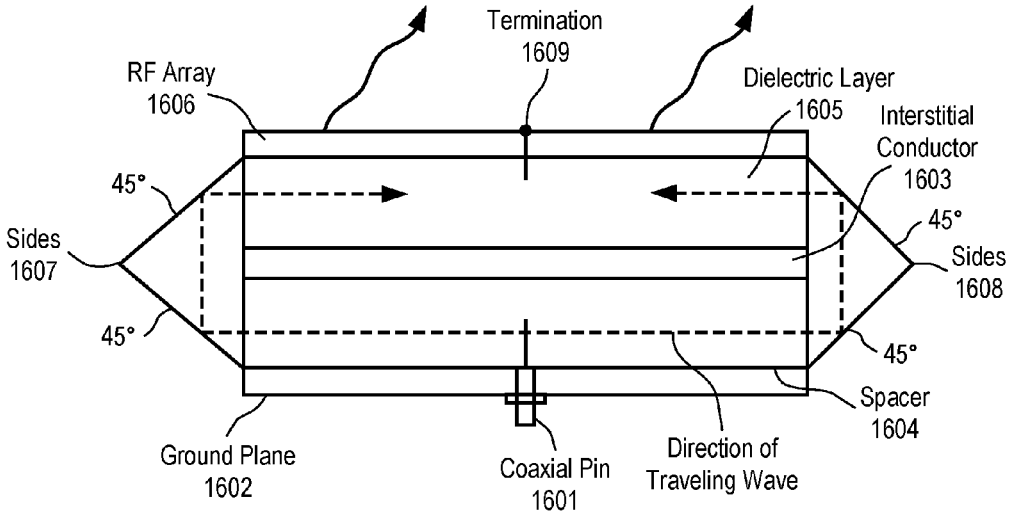
FIG. 16A illustrates a side view of one embodiment of a cylindrically fed antenna structure.

FIG. 16A illustrates a side view of one embodiment of a cylindrically fed antenna structure. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 16A includes the coaxial feed of FIG. 11.

Referring to FIG. 16A, a coaxial pin 1601 is used to excite the field on the lower level of the antenna. In one embodiment, coaxial pin 1601 is a 50Ω coax pin that is readily available. Coaxial pin 1601 is coupled (e.g., bolted) to the bottom of the antenna structure, which is conducting ground plane 1602.

Separate from conducting ground plane 1602 is interstitial conductor 1603, which is an internal conductor. In one embodiment, conducting ground plane 1602 and interstitial conductor 1603 are parallel to each other. In one embodiment, the distance between ground plane 1602 and interstitial conductor 203 is 0.1-0.15". In another embodiment, this distance may be λ/2, where λ is the wavelength of the travelling wave at the frequency of operation.

Ground plane 1602 is separated from interstitial conductor 1603 via a spacer 1604. In one embodiment, spacer 1604 is a foam or air-like spacer. In one embodiment, spacer 1604 comprises a plastic spacer.

On top of interstitial conductor 1603 is dielectric layer 1605. In one embodiment, dielectric layer 1605 is plastic. The purpose of dielectric layer 1605 is to slow the travelling wave relative to free space velocity. In one embodiment, dielectric layer 1605 slows the travelling wave by 30% relative to free space. In one embodiment, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 1605, such as periodic sub-wavelength metallic structures that can be machined or lithographically defined, for example.

An RF-array 1606 is on top of dielectric 1605. In one embodiment, the distance between interstitial conductor 1603 and RF-array 606 is 0.1-0.15". In another embodiment, this distance may be $\lambda_{eff}/2$, where $\lambda_{eff}$ is the effective wavelength in the medium at the design frequency.

The antenna includes sides 1607 and 1608. Sides 1607 and 1608 are angled to cause a travelling wave feed from coax pin 1601 to be propagated from the area below interstitial conductor 1603 (the spacer layer) to the area above interstitial conductor 1603 (the dielectric layer) via reflection. In one embodiment, the angle of sides 1607 and 1608 are at 45° angles. In an alternative embodiment, sides 1607 and 1608 could be replaced with a continuous radius to achieve the reflection. While FIG. 16A shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step. The steps on one end of the antenna go around the dielectric layer, interstitial the conductor, and the spacer layer. The same two steps are at the other ends of these layers.

In operation, when a feed wave is fed in from coaxial pin 1601, the wave travels outward concentrically oriented from coaxial pin 1601 in the area between ground plane 1602 and interstitial conductor 1603. The concentrically outgoing waves are reflected by sides 1607 and 1608 and travel inwardly in the area between interstitial conductor 1603 and RF array 1606. The reflection from the edge of the circular perimeter causes the wave to remain in phase (i.e., it is an in-phase reflection). The travelling wave is slowed by dielectric layer 1605. At this point, the travelling wave starts interacting and exciting with elements in RF array 1606 to obtain the desired scattering.

To terminate the travelling wave, a termination 1609 is included in the antenna at the geometric center of the antenna. In one embodiment, termination 1609 comprises a pin termination (e.g., a 50Ω pin). In another embodiment, termination 1609 comprises an RF absorber that terminates unused energy to prevent reflections of that unused energy back through the feed structure of the antenna. These could be used at the top of RF array 1606.

Figure 16B:
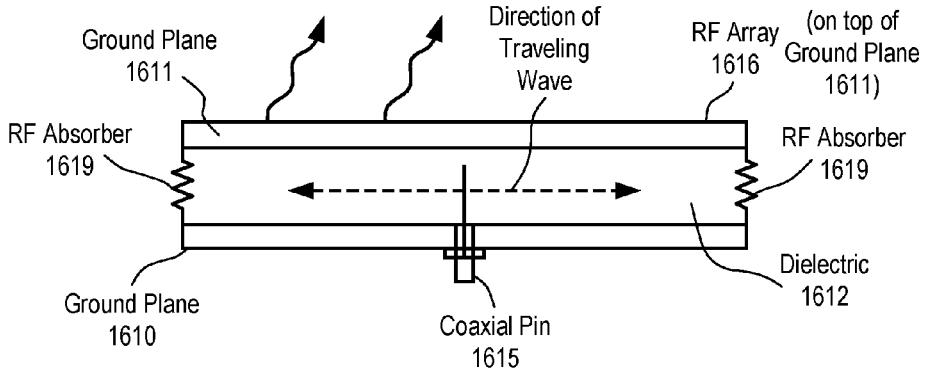
FIG. 16B illustrates another embodiment of the antenna system with an outgoing wave.

FIG. 16B illustrates another embodiment of the antenna system with an outgoing wave. Referring to FIG. 16B, two ground planes 1610 and 1611 are substantially parallel to each other with a dielectric layer 1612 (e.g., a plastic layer, etc.) in between ground planes. RF absorbers 1619 (e.g., resistors) couple the two ground planes 1610 and 1611 together. A coaxial pin 1615 (e.g., 50Ω) feeds the antenna. An RF array 1616 is on top of dielectric layer 1612 and ground plane 1611.

In operation, a feed wave is fed through coaxial pin 1615 and travels concentrically outward and interacts with the elements of RF array 1616.

The cylindrical feed in both the antennas of FIGS. 16A and 16B improves the service angle of the antenna. Instead of a service angle of plus or minus forty five degrees azimuth (±45° Az) and plus or minus twenty five degrees elevation (±25° El), in one embodiment, the antenna system has a service angle of seventy five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 1606 of FIG. 16A and RF array 1616 of FIG. 16B include a wave scattering subsystem that includes a group of patch antennas (i.e., scatterers) that act as radiators. This group of patch antennas comprises an array of scattering metamaterial elements.

In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty five degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Cell Placement

Figure 17:
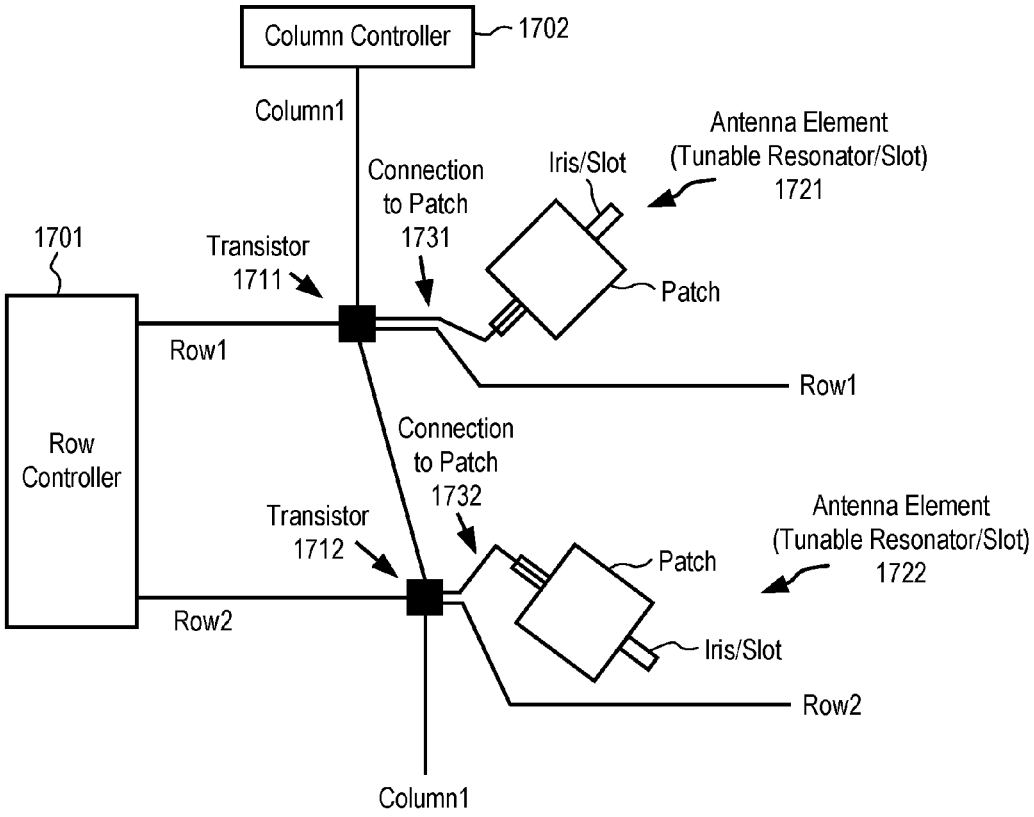
FIG. 17 illustrates one embodiment of the placement of matrix drive circuitry with respect to antenna elements.

In one embodiment, the antenna elements are placed on the cylindrical feed antenna aperture in a way that allows for a systematic matrix drive circuit. The placement of the cells includes placement of the transistors for the matrix drive. FIG. 17 illustrates one embodiment of the placement of matrix drive circuitry with respect to antenna elements. Referring to FIG. 17, row controller 1701 is coupled to transistors 1711 and 1712, via row select signals Row1 and Row2, respectively, and column controller 1702 is coupled to transistors 1711 and 1712 via column select signal Column1. Transistor 1711 is also coupled to antenna element 1721 via connection to patch 1731, while transistor 1712 is coupled to antenna element 1722 via connection to patch 1732.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercially available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

An Example System Embodiment

In one embodiment, the combined antenna apertures are used in a television system that operates in conjunction with a set top box. For example, in the case of a dual reception antenna, satellite signals received by the antenna are provided to a set top box (e.g., a DirecTV receiver) of a television system. More specifically, the combined antenna operation is able to simultaneously receive RF signals at two different frequencies and/or polarizations. That is, one sub-array of elements is controlled to receive RF signals at one frequency and/or polarization, while another sub-array is controlled to receive signals at another, different frequency and/or polarization. These differences in frequency or polarization represent different channels being received by the television system. Similarly, the two antenna arrays can be controlled for two different beam positions to receive channels from two different locations (e.g., two different satellites) to simultaneously receive multiple channels.

Figure 19:
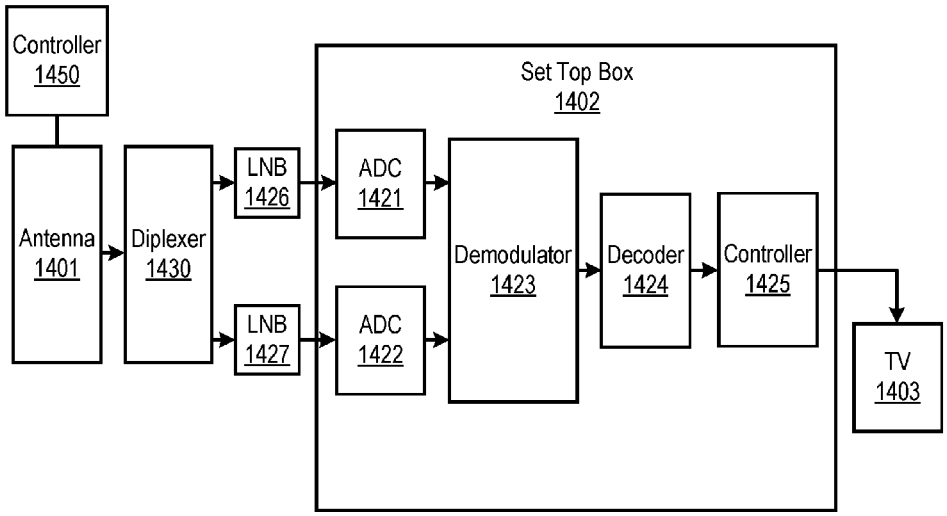
FIG. 19 is a block diagram of one embodiment of a communication system that performs dual reception simultaneously in a television system.

FIG. 19 is a block diagram of one embodiment of a communication system that performs dual reception simultaneously in a television system. Referring to FIG. 19, antenna 1401 includes two spatially interleaved antenna apertures operable independently to perform dual reception simultaneously at different frequencies and/or polarizations as described above. Note that while only two spatially interleaved antenna operations are mentioned, the TV system may have more than two antenna apertures (e.g., 3, 4, 5, etc. antenna apertures).

In one embodiment, antenna 1401, including its two interleaved slotted arrays, is coupled to diplexer 1430. The coupling may include one or more feeding networks that receive the signals from elements of the two slotted arrays to produce two signals that are fed into diplexer 1430. In one embodiment, diplexer 1430 is a commercially available diplexer (e.g., model PB1081WA Ku-band sitcom diplexor from A1 Microwave).

Diplexer 1430 is coupled to a pair of low noise block down converters (LNBs) 1426 and 1427, which perform a noise filtering function, a down conversion function, and amplification in a manner well-known in the art. In one embodiment, LNBs 1426 and 1427 are in an out-door unit (ODU). In another embodiment, LNBs 1426 and 1427 are integrated into the antenna apparatus. LNBs 1426 and 1427 are coupled to a set top box 1402, which is coupled to television 1403.

Set top box 1402 includes a pair of analog-to-digital converters (ADCs) 1421 and 1422, which are coupled to LNBs 1426 and 1427, to convert the two signals output from diplexer 1430 into digital format.

Once converted to digital format, the signals are demodulated by demodulator 1423 and decoded by decoder 1424 to obtain the encoded data on the received waves. The decoded data is then sent to controller 1425, which sends it to television 1403.

Controller 1450 controls antenna 1401, including the interleaved slotted array elements of both antenna apertures on the single combined physical aperture.

An Example of a Full Duplex Communication System

Figure 20:
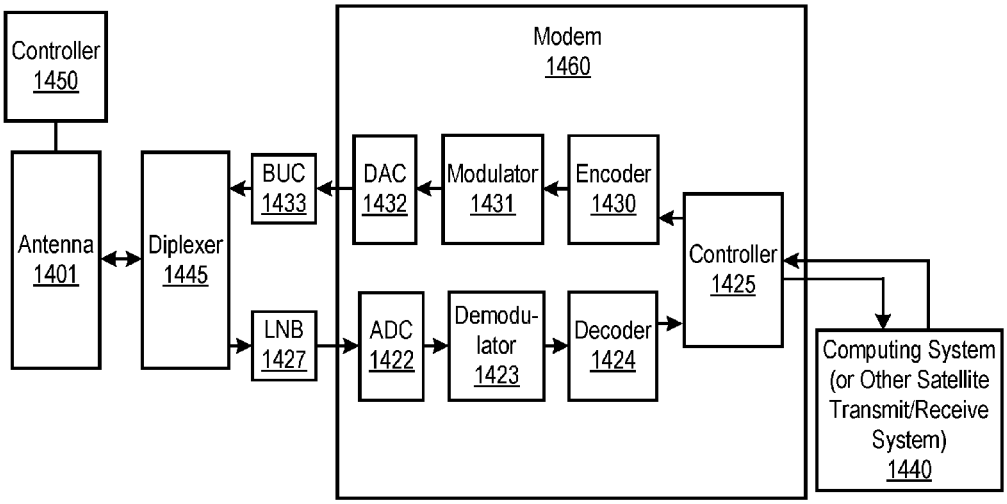
FIG. 20 is a block diagram of another embodiment of a communication system having simultaneous transmit and receive paths.

In another embodiment, the combined antenna apertures are used in a full duplex communication system. FIG. 20 is a block diagram of another embodiment of a communication system having simultaneous transmit and receive paths. While only one transmit path and one receive path are shown, the communication system may include more than one transmit path and/or more than one receive path.

Referring to FIG. 20, antenna 1401 includes two spatially interleaved antenna arrays operable independently to transmit and receive simultaneously at different frequencies as described above. In one embodiment, antenna 1401 is coupled to diplexer 1445. The coupling may be by one or more feeding networks. In one embodiment, in the case of a radial feed antenna, diplexer 1445 combines the two signals and the connection between antenna 1401 and diplexer 1445 is a single broad-band feeding network that can carry both frequencies.

Diplexer 1445 is coupled to a low noise block down converter (LNBs) 1427, which performs a noise filtering function and a down conversion and amplification function in a manner well-known in the art. In one embodiment, LNB 1427 is in an out-door unit (ODU). In another embodiment, LNB 1427 is integrated into the antenna apparatus. LNB 1427 is coupled to a modem 1460, which is coupled to computing system 1440 (e.g., a computer system, modem, etc.).

Modem 1460 includes an analog-to-digital converter (ADC) 1422, which is coupled to LNB 1427, to convert the received signal output from diplexer 1445 into digital format. Once converted to digital format, the signal is demodulated by demodulator 1423 and decoded by decoder 1424 to obtain the encoded data on the received wave. The decoded data is then sent to controller 1425, which sends it to computing system 1440.

Modem 1460 also includes an encoder 1430 that encodes data to be transmitted from computing system 1440. The encoded data is modulated by modulator 1431 and then converted to analog by digital-to-analog converter (DAC) 1432. The analog signal is then filtered by a BUC (upconvert and high pass amplifier) 1433 and provided to one port of diplexer 1445. In one embodiment, BUC 1433 is in an out-door unit (ODU).

Diplexer 1445 operating in a manner well-known in the art provides the transmit signal to antenna 1401 for transmission.

Controller 1450 controls antenna 1401, including the two arrays of antenna elements on the single combined physical aperture.

Note that the full duplex communication system shown in FIG. 20 has a number of applications, including but not limited to, internet communication, vehicle communication (including software updating), etc.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. An antenna comprising:

an antenna element array having a plurality of antenna elements and each antenna element having one or more cells;

drive circuitry coupled to cells in the antenna element array to provide a voltage to each of the cells, wherein the drive circuitry comprises a plurality of cell drivers, with a cell driver for each of the cells; and memory located locally with respect to the cells and external to a controller, to store a data value for each cell from the controller to determine whether the cell is on or off, the memory to output signals to individually drive an ON/OFF input of each cell driver.

2. The antenna defined in claim 1 wherein the one or more cells comprises a liquid crystal (LC) cell.

3. The antenna defined in claim 1 wherein the one or more cells comprises a MEMS radio frequency (RF) resonator cell.

4. The antenna defined in claim 1 wherein the cell driver comprises a switch operable to provide a first voltage or a second voltage to a cell in response to a control signal, the first voltage being an ON state voltage for the cell and the second voltage being an OFF state voltage for the cell, and further wherein control signal being responsive to one data value in the memory associated with the cell.

5. The antenna defined in claim 4 wherein the first voltage is an AC voltage and the second voltage is a ground voltage.

6. The antenna defined in claim 1 wherein the memory and the controller for the drive circuitry are located peripherally with respect to the antenna elements in the array with common ON and OFF state voltages for a group of cells, the ON state voltage being at a same frequency for the group of cells.

7. The antenna defined in claim 1 wherein each of the cell drivers comprises a portion of the memory coupled to a switch operable to provide a first voltage or a second voltage to a cell in response to a control signal, the first voltage being an ON state voltage for the cell and the second voltage being an OFF state voltage for the cell, and further wherein control signal being an output from the portion of memory in the cell driver.

8. The antenna defined in claim 7 wherein the portion of memory comprises a latch having:

a data input coupled to receive the data value for the cell that the cell driver is to drive and indicating whether the cell is to be in the ON state or the OFF state; and a latch output operable to output the control signal to control the switch.

9. The antenna defined in claim 8 wherein the cell drivers are arranged in a matrix configuration, the drive circuitry comprising a plurality of row signals and a plurality of column signals, wherein individual row signals of the plurality of row signals being coupled to enable inputs of latches in groups of cell drivers and individual column signals are coupled to data inputs of latches in groups of cell drivers.

10. The antenna defined in claim 1 wherein the drive circuitry comprises matrix drive circuitry having a matrix updated by updating data values in the memory.

11. The antenna defined in claim 1 wherein the voltage is an alternating current (AC) voltage.

12. The antenna defined in claim 1 further comprising:

an antenna feed to input a feed wave that propagates concentrically from the feed;

a plurality of slots;

a plurality of patches, wherein each of the patches is co-located over and separated from a slot in the plurality of slots using the cells and forming a patch/slot pair, each patch/slot pair being turned off or on based on application of a voltage to the patch in the pair specified by a control pattern.

13. The antenna defined in claim 1 wherein the antenna elements are controlled and operable together to form a beam for the frequency band for use in holographic beam steering.

14. The antenna defined in claim 1 wherein the array of antenna elements are part of a tunable slotted array, and wherein elements in the tunable slotted array are positioned in one or more rings.

15. The antenna defined in claim 14 wherein the slotted array comprises a plurality of slots, and further wherein each slot is tuned to provide a desired scattering at a given frequency.

16. The antenna defined in claim 15 wherein each slot of the plurality of slots is oriented either +45 degrees or −45 degrees relative to the cylindrical feed wave impinging at a central location of each said slot, such that the slotted array includes a first set of slots rotated +45 degrees relative to the cylindrical feed wave propagation direction and a second set of slots rotated −45 degrees relative to the propagation direction of the cylindrical feed wave.

17. An antenna comprising:

an antenna element array having a plurality of antenna elements with each antenna element having one or more cells, wherein at least a group of antenna elements are controlled and operable together to form a beam for the frequency band for use in holographic beam steering;

memory to store a data value for each cell in the antenna element array to indicate whether the cell is to be in an on state or an off state, wherein the memory is located locally with respect to the cells and external to a controller that provides the data value for each cell;

matrix drive circuitry with a plurality of cell drivers coupled to cells in the antenna element array to provide different voltages to each of the cells in response to the controller based on whether said each cell is in the on state or the off state based on data values in the memory, wherein one of the cell drivers is for each of the cells and the memory to output signals to individually drive an ON/OFF input of each cell driver.

18. The antenna defined in claim 17 wherein the one or more cells comprises a liquid crystal (LC) cell.

19. The antenna defined in claim 17 wherein the one or more cells comprises a MEMS radio frequency (RF) resonator cell.

20. The antenna defined in claim 17 wherein the cell driver comprises a switch operable to provide a first voltage or a second voltage to a cell in response to a control signal, the first voltage being an ON state voltage for the cell and the second voltage being an OFF state voltage for the cell, and further wherein control signal being responsive to one data value in the memory associated with the cell.

21. The antenna defined in claim 20 wherein the first voltage is an AC voltage and the second voltage is a ground voltage.

22. The antenna defined in claim 17 wherein the memory and the controller for the drive circuitry are located peripherally with respect to the antenna elements in the array with common ON and OFF state voltages for a group of cells, the ON state voltage being at a same frequency for the group of cells.

23. The antenna defined in claim 17 wherein each of the cell drivers comprises a portion of the memory coupled to a switch operable to provide a first voltage or a second voltage to a cell in response to a control signal, the first voltage being an ON state voltage for the cell and the second voltage being an OFF state voltage for the cell, and further wherein control signal being an output from the portion of memory in the cell driver.

24. The antenna defined in 23 wherein the portion of memory comprises a latch having:

a data input coupled to receive the data value for the cell that the cell driver is to drive and indicating whether the cell is to be in the ON state or the OFF state; and a latch output operable to output the control signal to control the switch.

25. The antenna defined in claim 24 wherein the cell drivers are arranged in a matrix configuration, the drive circuitry comprising a plurality of row signals and a plurality of column signals, wherein individual row signals of the plurality of row signals being coupled to enable inputs of latches in groups of cell drivers and individual column signals are coupled to data inputs of latches in groups of cell drivers.

26. The antenna defined in claim 17 wherein the matrix drive circuitry has a matrix updated by updating data values in the memory.

27. The antenna defined in claim 17 further comprising:

an antenna feed to input a feed wave that propagates concentrically from the feed;

a plurality of slots;

a plurality of patches, wherein each of the patches is co-located over and separated from a slot in the plurality of slots using the cells and forming a patch/slot pair, each patch/slot pair being turned off or on based on application of a voltage to the patch in the pair specified by a control pattern.

28. A method for controlling an antenna having a plurality of antenna elements, wherein each antenna element of the plurality of antenna elements has a cell, the method comprising:

determining which cells of the plurality of antenna elements are going to be in an ON state and in an OFF state;

programming data values in memory locations of memory for the cells to indicate whether each cell is to be in the ON state or the OFF state based on results of determining, the memory located locally with respect to the cells and external to an antenna array controller;

driving voltages to the cells based on programmed data values in the memory locations, including outputting signals to individually drive an ON/OFF input of each of a plurality of cell drivers, with a cell driver for each of the cells.

29. The method defined in claim 28 wherein driving voltages to the cells comprises controlling a switch to provide a first voltage or a second voltage to each cell in a group of cells in response to a control signal, the first voltage being an ON state voltage for the cell and the second voltage being an OFF state voltage for the cell, and further wherein control signal being responsive to one data value programmed in the memory location associated with the cell.

30. The method defined in claim 29 wherein the first voltage is an AC voltage and the second voltage is a ground voltage.

31. The method defined in claim 28 wherein programming data values in memory locations for the cells comprises setting a memory in each of a plurality of cell drivers operable to drive voltages to the cells and wherein driving voltages to the cells based on programmed data values in the memory locations comprises generating an output each of the cell drivers in a group of the cells, the output being the control signal.

32. The method defined in claim 31 further comprising:

sequentially programming rows of memory in rows of cell drivers by selecting a row of cell drivers in a matrix using a row control signal, and sequentially asserting column control signals to cause data to be stored into the memory of each cell driver in the row of cell drivers.

* * * * *